US005556321A

United States Patent [19]

Kasahara et al.

[11] Patent Number: 5,556,321

[45] Date of Patent: Sep. 17, 1996

[54] METHOD AND APPARATUS FOR GRINDING ELONGATED KNIFE BLADE

[75] Inventors: Yoshiyuki Kasahara, Aichi-Ken; Hajime Segawa, Komaki; Mikio Yamauchi, Nagoya; Toshihiro Kuno, Oobu; Hiroshige Mizutani, Kuwana; Yuzo Kawai, Kariya, all of Japan

[73] Assignee: Kabushiki Kaisha Taihei Seisakusho, Aichi-Ken, Japan

[21] Appl. No.: 192,712

[22] Filed: Feb. 7, 1994

[51] Int. Cl.[6] ..... B24B 1/00

[52] U.S. Cl. ..... 451/5; 451/7; 451/45

[58] Field of Search ..... 451/5, 7, 9, 10, 451/11, 45, 53, 128, 225, 229, 230

[56] References Cited

U.S. PATENT DOCUMENTS

| | | | |
|---|---|---|---|
| 3,909,985 | 10/1975 | Knecht | 451/276 |
| 4,313,283 | 2/1982 | Smith | 451/160 |
| 4,442,635 | 4/1984 | Smith | 451/160 |
| 4,685,250 | 8/1987 | Smith | 451/160 |
| 4,984,394 | 1/1991 | Suzuki et al. | 451/160 |
| 5,119,600 | 6/1992 | Chikatsune et al. | 451/8 |
| 5,233,792 | 8/1993 | Suzuki | 451/160 |
| 5,287,658 | 2/1994 | Attanasio et al. | 451/160 |

FOREIGN PATENT DOCUMENTS 5-38666 2/1993 Japan .

*Primary Examiner*—Maurina T. Rachuba
*Attorney, Agent, or Firm*—Ladas & Parry

[57] ABSTRACT

An apparatus for grinding an elongated knife blade used in a veneer lathe or a veneer slicer has a blade mount with a mounting surface on which the blade is fixed. In order to prevent a thermal distortion of the cutting edge of the blade after it has been ground by the grinding wheel and naturally cools, the blade mount and the blade thereon are cooled by supplying a cooling medium even to an intervening surface or area therebetween. The blade and mount are also cooled entirely by direct contact with the cooling medium. The grinding wheel is controlled such that when it is lowered to abut against the blade, a resistance torque increase is detected and the grinding wheel is raised slightly to a grinding start level from where the grinding feed and stroke of the wheel is started so that interference between the wheel and the blade is prevented during the initial longitudinal stroke of the wheel along the blade.

32 Claims, 22 Drawing Sheets

METHOD AND APPARATUS FOR GRINDING ELONGATED KNIFE BLADE

BACKGROUND OF THE INVENTION

The present invention relates to a method and an apparatus for grinding an elongated knife blade used for a veneer lathe or a veneer slicer. The elongated knife blade is of a length of the order of from one meter to more than three meters.

A veneer lathe is a machine for producing a veneer from a bolt of wood or log. An elongated knife blade is stationarily provided in the veneer lathe and acts on a bolt of wood or log which is gripped between a pair of rotary chucks and rotated around an axis. The knife blade cuts into the peripheral surface of the log as the log is rotated, and peels off a veneer continuously from the log. Such a knife blade can also be used in a veneer slicer. The knife blade must be ground by a grinding wheel to sharpen it after use.

For grinding a knife blade of the above type, it has been a conventional way to apply the grinding wheel to the front or back surface of the cutting edge of the blade and to reciprocate the grinding wheel along and in contact with the cutting edge while the grinding wheel is rotated around its axis. This grinding operation is carried out while the knife blade is mounted in the veneer lathe or veneer slicer, or alternatively after the knife blade is dismounted from the veneer lathe or slicer and is then fixedly mounted on a knife blade mount provided separately from the veneer lathe or slicer.

Before carrying out the grinding operation, either a knife blade mounting stand in front of a knife blade mount of the veneer lathe, or the separate knife blade mount mentioned above is made to have a flat, smooth and level mounting surface on which the knife blade to be ground is fixedly mounted in close surface-to-surface contact throughout its entire length and width.

On the other hand, a grinding liquid (such as water or grinding oil) is ejected to the grinding region which moves along the cutting edge of the knife blade, especially in the case of using the separately provided knife blade mount, because considerable heat is generated during the grinding operation due to high speed rotation of the grinding wheel relative to the knife blade and because burning, cracking and other degradation of the blade as a result of such heat generation must be prevented.

By taking the above measures of causing the knife blade mount to have a flat, smooth and level mounting surface and of ejecting the grinding liquid to the grinding region and further by taking a measure of reciprocating the grinding wheel in parallel with the straight cutting edge, the knife blade that has been ground should have a straight shape in the longitudinal direction of the blade. However, in reality, it has not been possible heretofore to obtain a truly straight shape of the knife blade after the grinding.

For this reason it has been a practice to affix the knife blade that has been ground to a knife mount of the veneer lathe, by making the following troublesome adjusting provision. That is, the knife mount is provided with knife blade pushing bolts and knife blade pulling bolts which are oriented transversely to the longitudinal direction of the blade and disposed at intervals in the longitudinal direction of the blade and which act on the blade edge opposite the cutting edge to exert transverse forces to the blade at various positions along the length of the blade. By adjusting the pushing and pulling bolts in different transverse directions and to different degrees, the cutting edge of the blade is made strictly straight even in the case where the ground knife blade is not straight.

The reason why it has not been possible to obtain a truly straight shape of the knife blade even after a grinding in parallel to the cutting edge is as follows. When the knife blade is ground in parallel to the cutting edge while the knife blade is affixed to a flat, smooth and level mounting surface of the mount, the cutting edge will be made straight immediately after the grinding operation but the cutting edge will undergo a thermal deformation in both the longitudinal and transverse directions due to temperature drop after the grinding.

The knife blade is in close surface-to-surface contact with the mounting surface of the knife blade mount during the grinding. Furthermore the knife blade is mounted on the mount in such a manner that longitudinal thermal expansion of the blade is restricted especially at the two ends thereof. Therefore, as the knife blade cools after the grinding, it undergoes such a deformation that a longitudinally intermediate portion thereof becomes concave on the front side, that is, the blade is curved into an arcuate plate shape. Furthermore, as the knife blade cools after the grinding, the blade also undergoes such a deformation that the proximal edge opposite the cutting edge of the blade is more contracted longitudinally than the cutting edge so that the blade is in the shape of a sector, because of a difference in the amount of generated heat between the regions of the proximal and cutting edges and because of the gradually decreasing thickness of the blade toward the cutting edge.

A difference in thermal deformation also occurs in the knife blade mount. The mounting surface of the mount is influenced by the differentially generated temperature of the knife blade thereon. A mounting surface portion in contact with a portion of the blade being ground in which more heat is generated, is more affected than another mounting surface portion in contact with another portion of the blade in which less heat is generated, so that different thermal stresses are produced in the same mounting surface. A further difference in thermal deformation occurs in the knife blade mount in the direction toward and away from the knife blade. That is to say, the mounting surface in contact with the knife blade is subjected to a more thermal expansion than a portion of the knife blade mount away from the mounting surface. Such differences in thermal expansion and stress in the mount are fed back to the knife blade fixed to the mount and cause the knife blade to be deformed into a curved shape in which a central portion with respect to the longitudinal and transverse directions are raised than the other portion.

When the knife blade fixed to such a deformed mount is ground by the reciprocating grinding wheel, the central portion of the blade will be ground more than the other portion so that when the knife blade cools after the grinding, the thickness of the cutting edge will become larger from the central portion toward the longitudinal end portions. This must be avoided.

Apart from the cooling of the knife blade that occurs by supplying a cooling medium to the grinding region, the feed of the grinding wheel to the cutting edge of the knife blade fixed to the mount has heretofore been carried out by rapidly lowering the rotating grinding wheel to a level close to the cutting edge surface, further gradually lowering the grinding wheel while being reciprocated longitudinally of the cutting edge, confirming with the operator's eye either a sound of contact of the grinding wheel with the cutting edge surface or a spark produced at the time of contact of the grinding wheel with the cutting edge surface, and then feeding the grinding wheel into the cutting edge by a preset amount to carry out the grinding while reciprocating the grinding wheel.

As an alternative measure for starting a grinding operation, a method has been proposed in which the grinding wheel being rotated is incrementarily fed toward the knife blade and a detection is made of a variation of the rotational speed of the grinding wheel at the instant the grinding wheel touches the cutting edge surfaces to thereby detect the position of the start of the grinding. This method is disclosed in Japanese Patent Laid Open Publication No. 3-55,151 published in 1991.

According to the above method of lowering the grinding wheel to the cutting edge while being rotated and reciprocated, the grinding wheel takes a zig-zag path while approaching the cutting edge. This necessitates a considerably long time. Moreover, the point at which the grinding wheel first contacts the cutting edge surface is not always a highest portion of the cutting edge surface. If the first contact point is not a highest portion, the grinding wheel will encounter the highest portion later during its movement along the cutting edge surface and will be subjected to an overloading so that the grinding wheel and/or the cutting edge will suffer a damage.

In contrast, the method disclosed in Japanese Patent Laid Open Publication No. 3-55,151 referred to above makes it unnecessary to cause the grinding wheel to take a zig-zag path in approaching the cutting edge surface and can shorten the time but with the above stated disadvantage of not being able to determine the highest portion of the cutting edge surface. Furthermore, the first contact of the grinding wheel with the cutting edge surface for the purpose of confirming the contact of the grinding wheel with the cutting edge surface, causes an excessive grinding of the surface together with a burning and/or degradation of the surface, which necessitates a further grinding.

SUMMARY OF THE INVENTION

The present invention has been made to eliminate the disadvantages stated above, and its main object is to provide a method and apparatus for grinding an elongated knife blade, especially for use in a veneer lathe or a veneer slicer, in which heat generation during the grinding operation is effectively prevented whereby the deformation of the knife blade does not occur after the grinding and a straight cutting edge of the knife blade is ensured.

Another object of the present invention is to provide a method and apparatus for grinding an elongated knife blade in which the grinding can be carried out in a short time.

According to the present invention, in one aspect thereof, there is provided a method for grinding an elongated knife blade having a cutting edge along a longitudinal side thereof, comprising the steps of: fixing the elongated knife blade to a mounting surface of a blade mount; reciprocating a grinding wheel supported by a carriage along and in contact with the cutting edge to grind the same; and maintaining a major portion of a major surface of the knife blade on the mounting surface in constant contact with a cooling medium while the grinding wheel is grinding the cutting edge.

According to the present invention, in another aspect thereof, there is provided an apparatus for grinding an elongated knife blade having a cutting edge along a longitudinal side thereof, comprising: a blade mount having a mounting surface for fixedly mounting the elongated knife blade thereon; a grinding wheel; a carriage movable reciprocatingly along the knife blade on the blade mount and carrying the grinding wheel; motive means for moving the carriage so as to cause the grinding wheel carried by the carriage to reciprocatingly move along and in contact with the cutting edge of the knife blade to grind the same; and cooling means provided for the mounting surface of the blade mount for maintaining a major portion of a major surface of the knife blade fixed to the mounting surface in constant contact with a cooling medium supplied to the cooling means, while the grinding wheel is grinding the cutting edge.

Preferred embodiments of the present invention will be understood from the following detailed description with reference to the accompanying drawings.

DETAILED DESCRIPTION OF THE PREFERRED EMBODIMENTS

Figure 1:
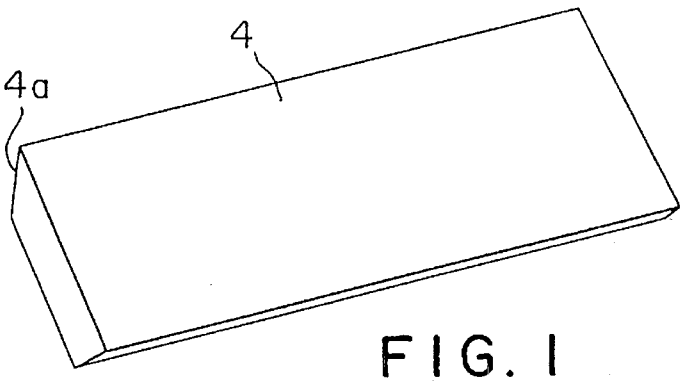
FIG. 1 is a perspective view of a knife blade to be ground by the present invention.

An elongated knife for a veneer lathe or a veneer slicer, to be ground by a knife grinding method and apparatus in accordance with the present invention, is of a length of, for example, from approximately 1 to 3.3 meters. The knife is in the form of a blade 4 having a cutting edge 4*a* as shown in FIG. 1.

Figure 2:
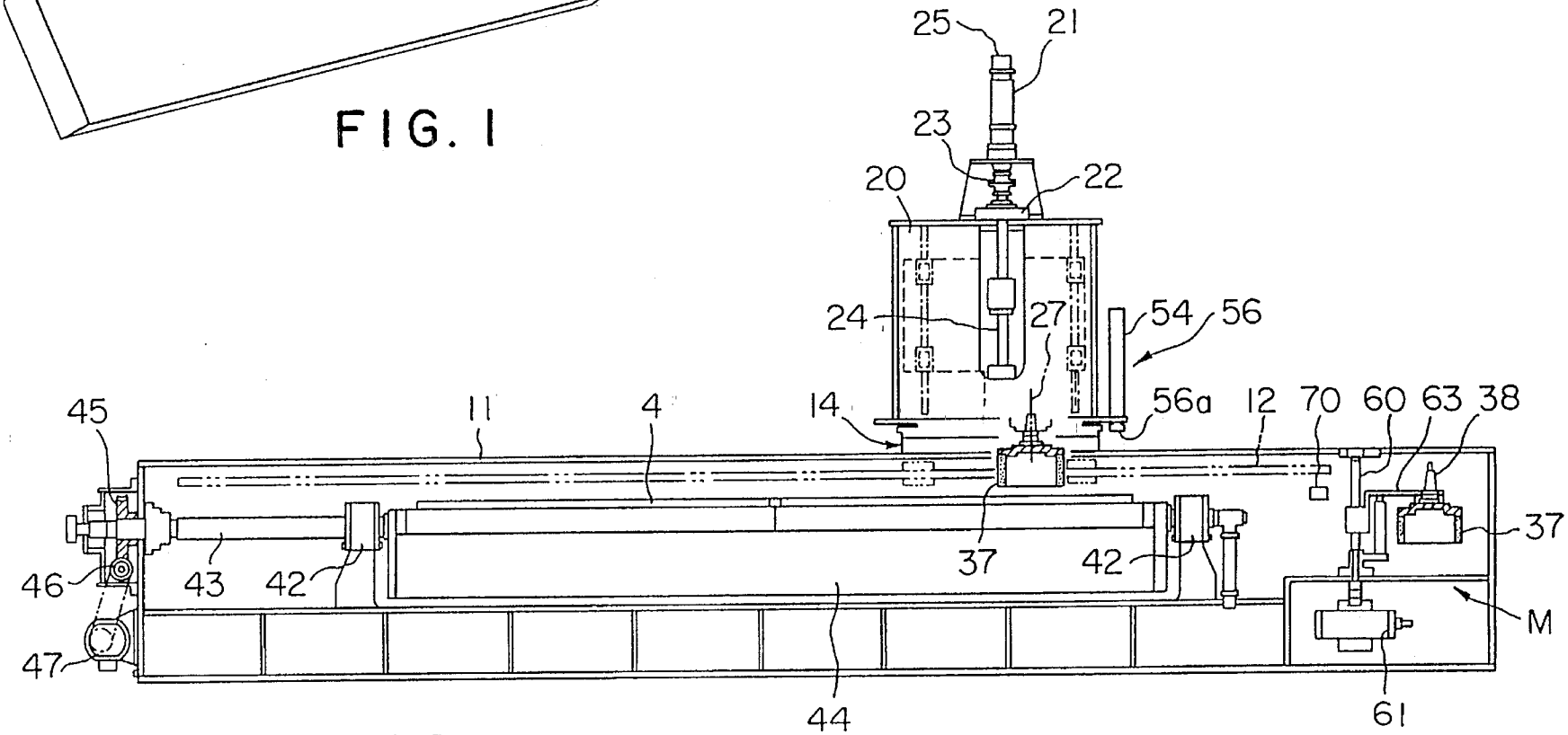
FIG. 2 is an elevational view of an apparatus for grinding an elongated knife blade according to the present invention.
Figure 3:
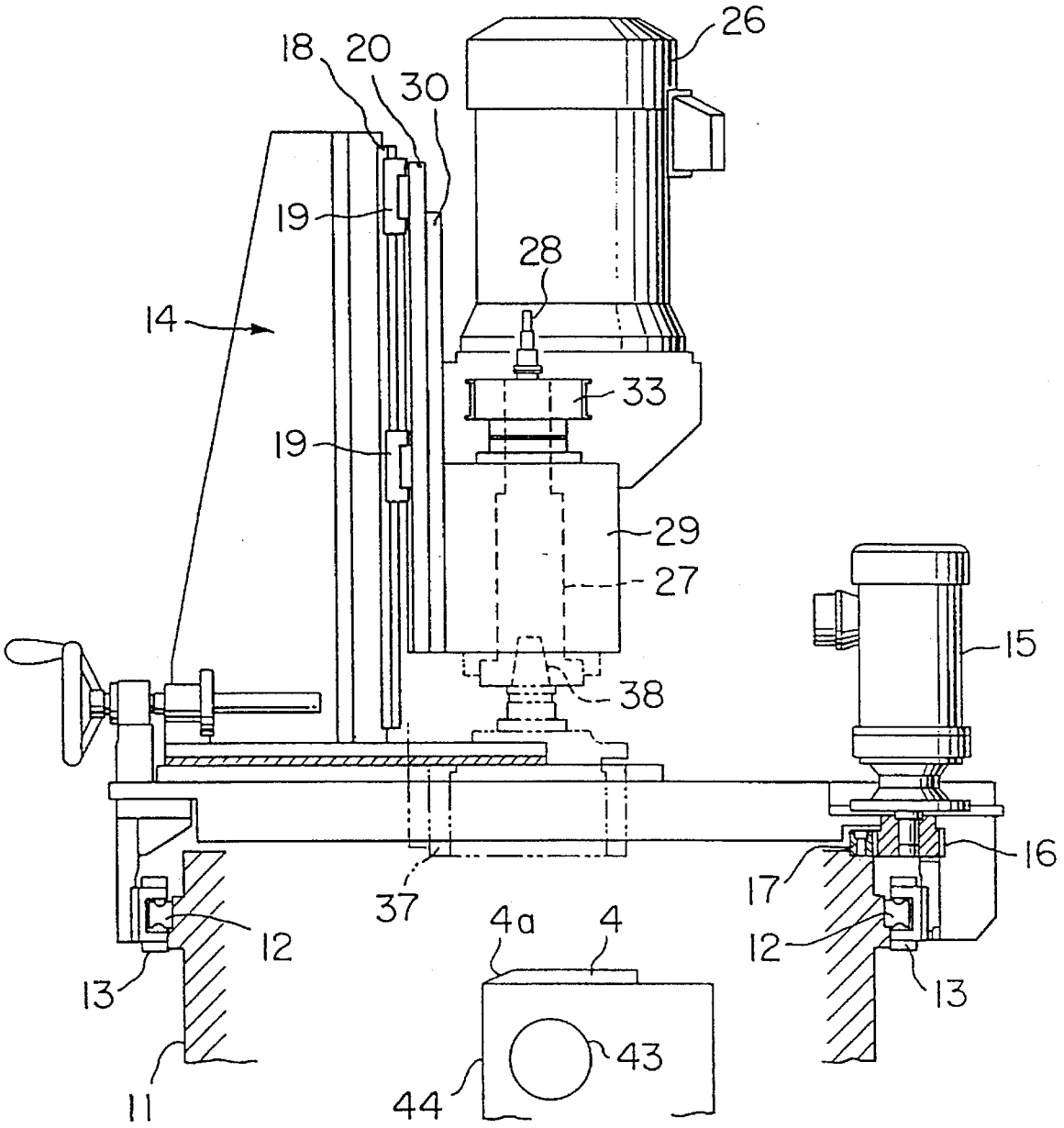
FIG. 3 is a fragmentary side view, on an enlarged scale, of the apparatus shown in FIG. 2.

The grinding apparatus for grinding the cutting edge 4*a* of the blade 4 comprises an elongated bed 11 having a length equal to or greater than that of the blade 4 as shown in FIG. 2. As shown in FIG. 1, the blade 4 is removably mounted on a blade mount 44 disposed inside the bed 11. The bed 11 includes on its lengthwise sides a pair of guide means 12 such as guide grooves of a dovetail cross section or another cross section, a pair of ballways, as shown in FIG. 3. The guide means 12 support a pair of linear traveling blocks 13, respectively, in a manner to be slidable relative to the guide means 12. A portal carriage 14 is mounted at its four corners on the traveling blocks 13 and is capable of longitudinal travel along the bed 11 by means of a drive motor 15. The motor 15 may be a hydraulic motor or an electric motor mounted on the carriage 14 as shown. In the case of FIG. 3, the motor 15 has a pinion 16 meshing with a rack 17 which is secured along one lengthwise side of the bed 11 so as to drivingly slide the carriage 14 in parallel with the bed 11.

Figure 4:
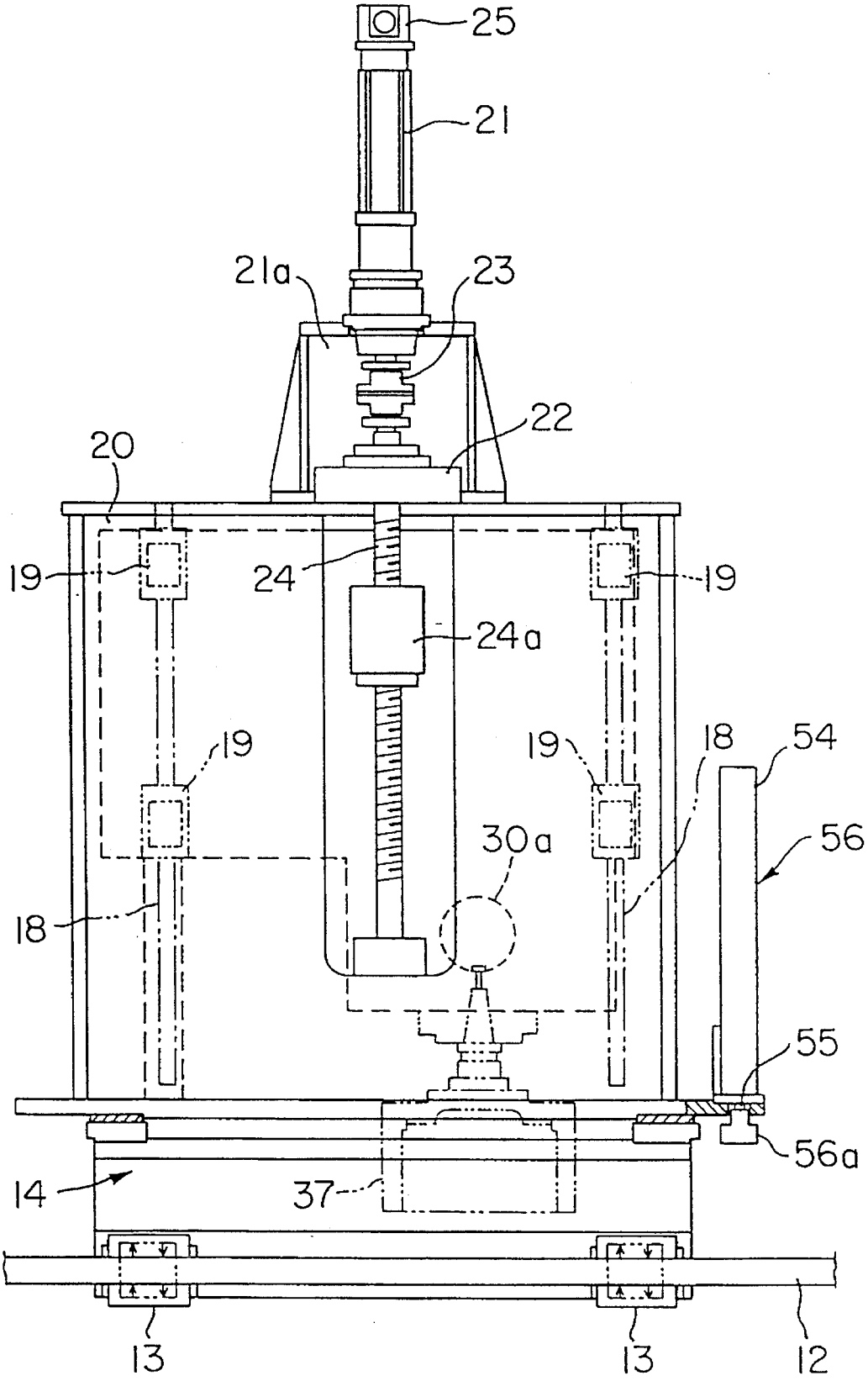
FIG. 4 is an enlarged view of a portion of FIG. 2.

The front surface of the carriage 14 or its right-hand surface in FIG. 3 has a pair of vertically extending guide means 18, as shown in FIG. 4, having substantially the same configuration as the guide means 12 and spaced apart from each other in the traveling direction of the carriage 14. A pair of linear traveling blocks 19 are mounted on each of the guide means 18 so as to be slidable therealong. The traveling blocks 19 fixedly support a planar rectangular slide 20 at the four corners of the slide. As shown in FIG. 4, the carriage 14 carries on its top a rotary drive mechanism 21 such as a fluid actuator or an AC servomotor, by way of a mount 21*a*. The output shaft of the rotary drive mechanism 21 has a coupling 23 through which is connected a feed shaft 24 that is passed through a bearing 22. The feed shaft 24 is, for example, a ball thread shaft connected to the lower end of the coupling 23 and is in screw engagement with a nut 24*a* on the back of the slide 20 so as to cause a vertical displacement of the slide 20 through the operation of the drive mechanism 21. The drive mechanism 21 is fitted with a displacement measuring instrument 25 for detecting the amount of upward or downward displacement of the slide 20. The measuring instrument 25 may be an encoder for detecting the number of pulses to be produced in a positive or negative direction with the rotation of the feed shaft 24.

Figure 5:
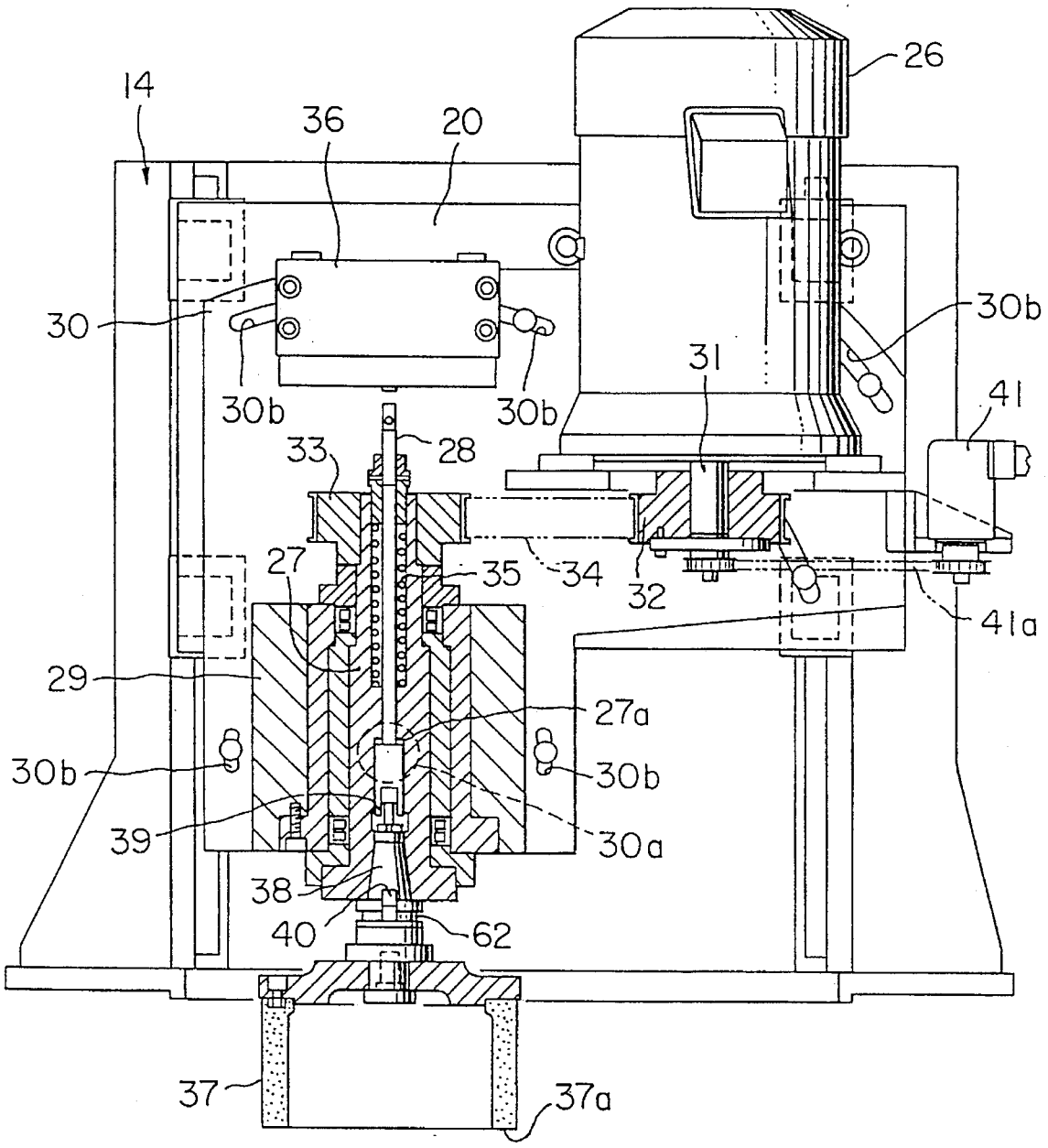
FIG. 5 is a rear view of FIG. 4 with some portions shown in vertical section.

Referring again to FIG. 3, there is shown a mounting plate 30 screwed to the surface of the slide 20 and supporting thereon a motor 26 for the rotation of a grinding wheel 37. As shown in FIG. 5, the mounting plate 30 securely holds thereon a vertical hollow rotational shaft 27, a linking rod 28 disposed within the shaft 27, and a bearing 29 which rotatably supports the rotational shaft 27. A pulley 32 fitted to the tip of an output shaft 31 of a motor 26 is drivingly connected by way of a belt 34 to a pulley 33 fitted to the upper end of the rotational shaft 27. The hollow interior of the rotational shaft 27 has in the middle thereof a shoulder 27*a* to form an enlarged hole which has a tapered or flared portion therebelow. In an annular space defined between the upper inner periphery of the rotational shaft 27 and the linking rod 28 is interposed a spring 35 to constantly urge the linking rod 28 upward. A fluid cylinder 36 is mounted above the linking rod 28 to overwhelm the force of the spring 35 so as to press the top end of the linking rod 28 downward. The linking rod 28 has at its lower end a downward opening for receiving a reduced-diameter top end of a tapered head stub shaft 38 of the grinding wheel 37 which is cup-shaped for grinding the cutting edge 4*a* of the blade 4. The downward opening further receives a spring or a support ball 39 which is in engagement with the reduced-diameter portion of the stub shaft 38. The top of the stub shaft 38 can be detachably held in the downward opening of the linking rod 28 in a manner well known in the art for detachably holding a machining tool in an automatic tool change system. Detailed description will therefore not be made here.

The rotational shaft 27 has at its lower end a vertically extending key or a keyway as shown so as to mate with a keyway vertically provided on the stub shaft 38 or a key 40 provided as shown, to thereby rotate the rotational shaft 27 and the stub shaft 38 together. There is provided an encoder 41 mounted on the mounting plate 30 and intercoupled with the output shaft 31 by way of a timing belt 41*a*. The encoder 41 is used for an angular positioning control as will be described later.

The mounting plate 30 is allowed to rotate in a vertical plane parallel to the surface of the slide 20 through a rotary shaft 30*a* (FIGS. 4 and 5) relative to the slide 20 and can be secured in any rotary position by means of stopper pins. Arcuate guide slots 30*b* (FIG. 5) through which pins fixed to the surface of the slide 20 pass, enable rotary movement of the mounting plate 30 about the rotary shaft 30*a*. Thus, the swing angle of the grinding wheel 37 with respect to the edge 4*a* and the angle at which the periphery of the grinding wheel 37 abuts against the edge 4*a* can be adjusted to prevent occurrence of a downcut grinding and an uppercut grinding which will take place when the annular grinding surface 37*a* (FIG. 5) of the cup-like grinding wheel 37 is caused to abut against the surface of the edge 4*a* of the blade 4 at an angle. To this end, the axis of the rotational shaft 27 is slightly inclined relative to the normal to the blade surface. The carriage 14 includes a balance weight or a fluid cylinder acting on the carriage so as to balancingly support the total weight of the slide 20 and the components mounted on the slide 20, to thereby ensure smooth advancing and retracting movements of the slide 20 by means of the drive mechanism 21.

Turning back to FIG. 2, bearings 42 provided in the vicinity of longitudinal ends of the bed 11 support a horizontal shaft 43 to which is fixedly secured the blade mount 44 in parallel with the bed 11. A worm wheel 45 is securely fastened to one end of the shaft 43 and is engaged with a worm 46 which is rotated by a motor 47 mounted at one end of the bed 11. Thus, the angle of the blade mount 44 can be changed by the operation of the motor 47. The blade mount 44 may include a plurality of spaced blade holders which may be fluid-operated (hydraulic or pneumatic) or screw-operated to fix the blade 4. Alternatively, the mount 44 itself may be constituted as a magnet chuck to be electrically excited for the attraction or release of the blade 4. In the latter case, the blade holders are not required.

Figure 7:
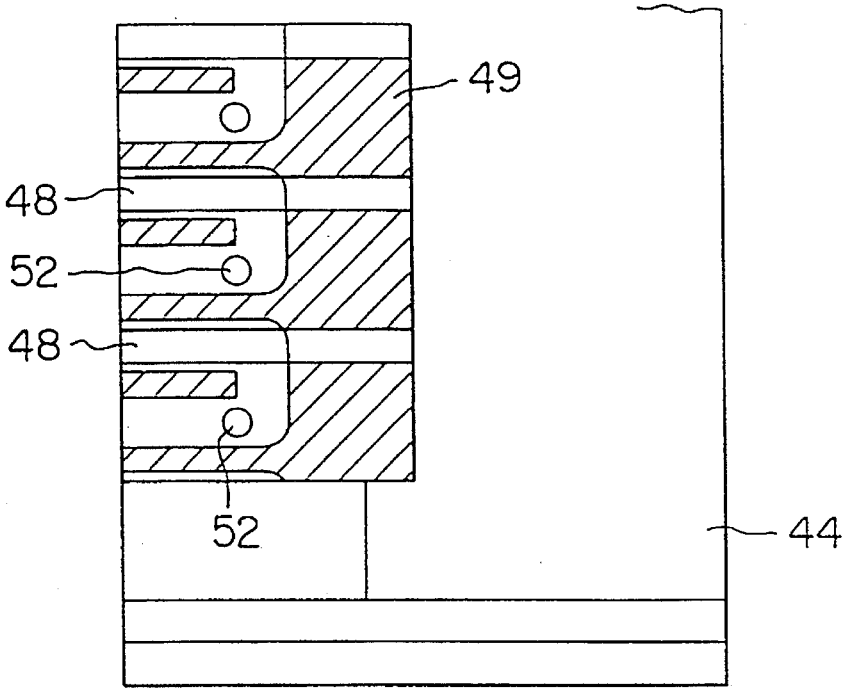
FIG. 7 is a plan view of a knife blade mount with its blade support shown in horizontal section.
Figure 8:
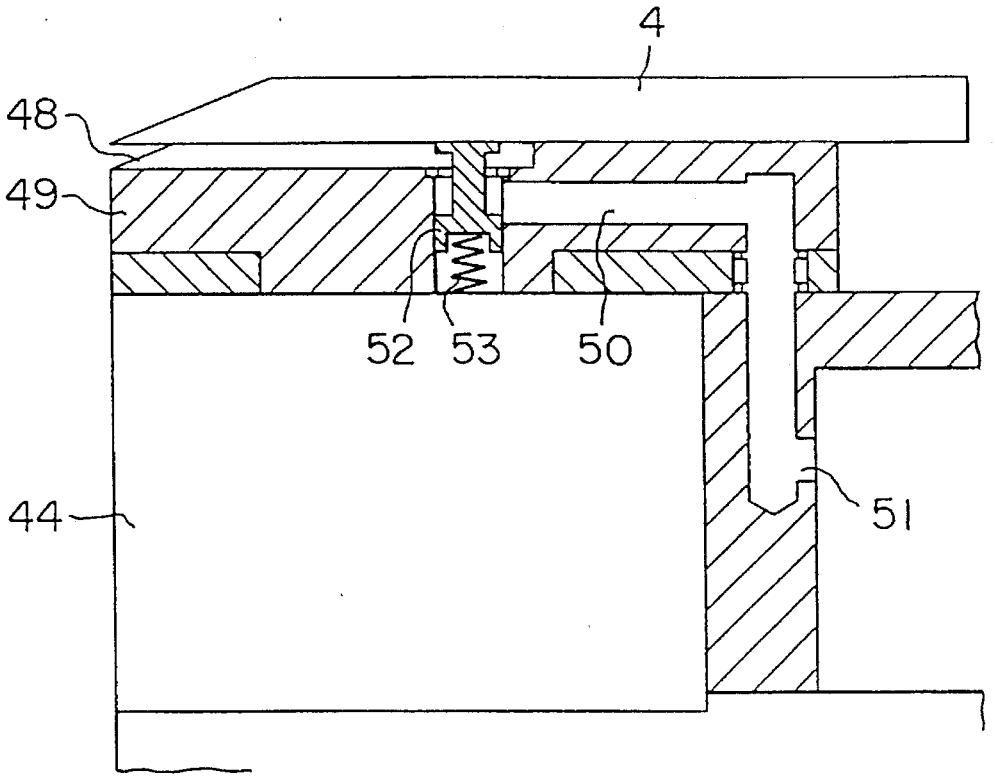
FIG. 8 is a vertical section of the knife blade mount shown in FIG. 7.

As shown in FIGS. 7 and 8, the blade mounting surface of the mount 44 constituted as a magnet chuck may have thereon a plurality of protruding flat support bars 48 intended to support the back of the blade 4 and arranged with spaces therebetween to be supplied with a cooling medium by way of flexible tubes. Alternatively, the blade mount 44 may be provided with a separate blade support 49 on which a plurality of flat support bars 48 supporting the back of the blade 4 are protrusively formed with spaces therebetween to be supplied with a cooling medium through conduits 50 formed in the blade mount 44. The conduits 50 communicate with a cooling medium supply port 51 provided at the rear portion of the magnet chuck 44 to lead the cooling medium to the back of the blade 4 into the spaces between the flat support bars 48.

The blade support 49 further includes at the ends of the conduits 50 valve members 52 upwardly biased by springs 53, respectively. In a normal condition the valve members 52 are caused to protrude upward from the upper surfaces of the flat support bars 48 to block the conduits 50, whereas at the time of the fixing of the blade 4 they open the conduits 50. More specifically, in the absence of the blade 4 on the blade mount 49 the valve members 52 are upwardly displaced by virtue of the biasing force of the springs 53 to block the conduits 50 to prevent the supply of the cooling medium. During the presence of the blade 4 on the blade support 49, the back of the blade 4 urges the valve members 52 to be displaced downward against the biasing force of the springs 53 to permit the cooling medium to be led into the spaces between the flat support bars 48. This enables the flow of the cooling medium to be controlled depending on the presence or absence of the blade 4 on the blade support 49.

Referring back to FIG. 4, the carriage 14 has at its one side with respect to its transfer direction a distance measuring instrument 56 to measure the distance to the face of the edge 4*a* at least in longitudinal end portions of the blade 4 mounted on the blade mount 44. The measuring instrument 56 may be of a non-contact type using ultrasonic waves or photoelectric tubes, or a screw-operated type using a feed screw shaft, or, as shown, a contact type having a detector 56*a* connected to the tip of a rod 55 of a fluid cylinder 54 incorporating an encoder.

Figure 9:
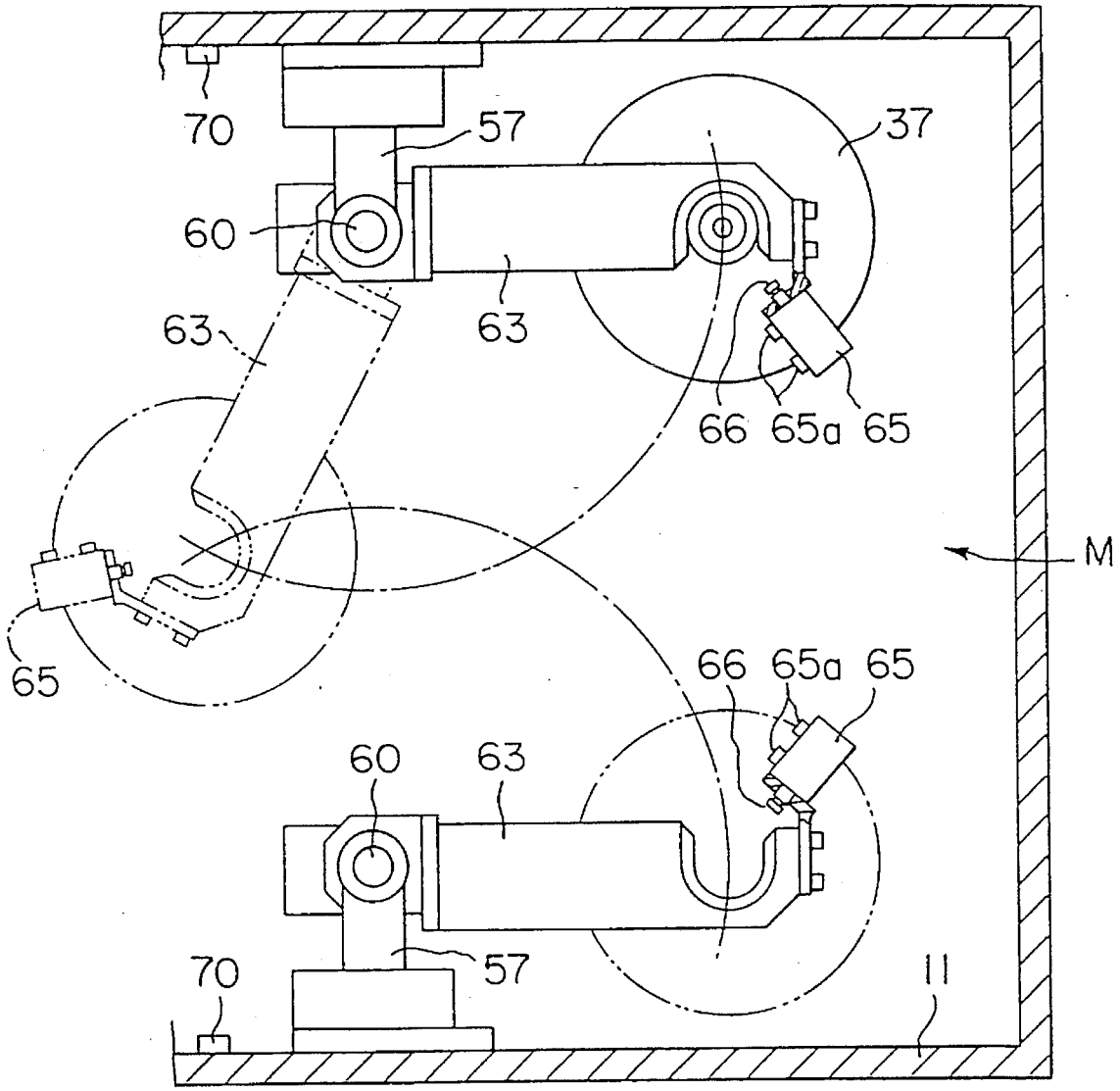
FIG. 9 is a plan view of a grinding wheel magazine enclosing grinding wheel support arms.
Figure 10:
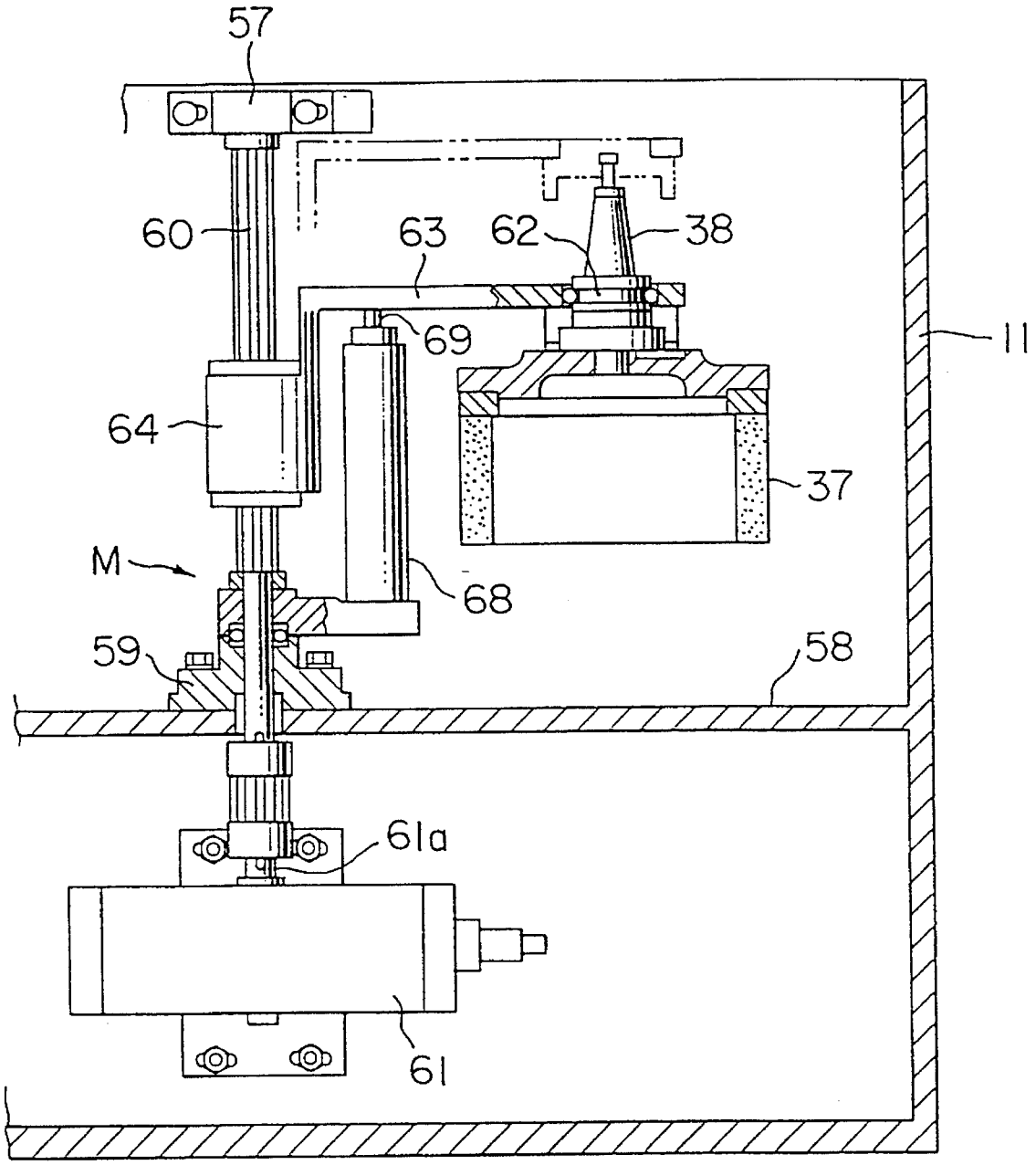
FIG. 10 is a vertical sectional view of the grinding wheel magazine of FIG. 9.

The bed 11 includes at its one end in its lengthwise direction, that is, in the direction where the blade mount 44 extends, a magazine mechanism M (FIG. 2) for storing a plurality of grinding wheels 37 having different grades. The magazine mechanism M, as shown in FIGS. 9 and 10 in detail, comprises a bearing 57 mounted on the inside of the bed 11, a support plate 58 located at a given height above the bottom of the bed 11, a bearing 59 mounted on the support plate 58, a longitudinally key-grooved or splined rotational shaft 60 supported between the bearings 57 and 59, and a fluid cylinder 61 of hydraulic or pneumatic type as shown or a motor coupled to the base end of the rotational shaft 60. The fluid cylinder 61 has an output shaft 61*a* which rotates in response to the stroke of the fluid cylinder 61 and is coupled to the rotational shaft 60 so as to cause a rotation thereof within a given angle. The magazine mechanism M further comprises a slide member 64 slidably mounted on the rotational shaft 60 through the key groove or spline formed thereon, and a support arm 63 extending from the slide member 64 and fitted at its distal end into an annular groove 62 formed in the head stub shaft 38 of the grinding wheel 37. A fluid cylinder 65 with reed switches 65*a* as shown in FIG. 9 is mounted on the extremity of the support arm 63 so as to prevent the disengagement of the head stub shaft 38 of the grinding wheel 37 when a plunger rod 66 of the cylinder 65 is caused to project. Although in FIG. 9 a pair of the same mechanisms as described above are placed in a confronting manner at one end in the inside of the bed 11, a plurality of such mechanisms may be arranged in series in the direction of the length of the bed 11. The number of the grinding wheels to be stored can be selected appropriately. In the case of storing four grinding wheels, for example, four magazine mechanisms M may be separately provided at the lengthwise ends of the blade mount 44; or two pairs of the mechanisms M may be placed on the confronting insides of the bed 11; or four mechanisms M may be longitudinally arranged in series. The rotation of the rotational shaft 60 causes the grinding wheel 37 to be conveyed as shown by imaginary lines. Further, extension and contraction of a fluid cylinder 68 causes the support arm 63 to be vertically displaced.

Figure 11:
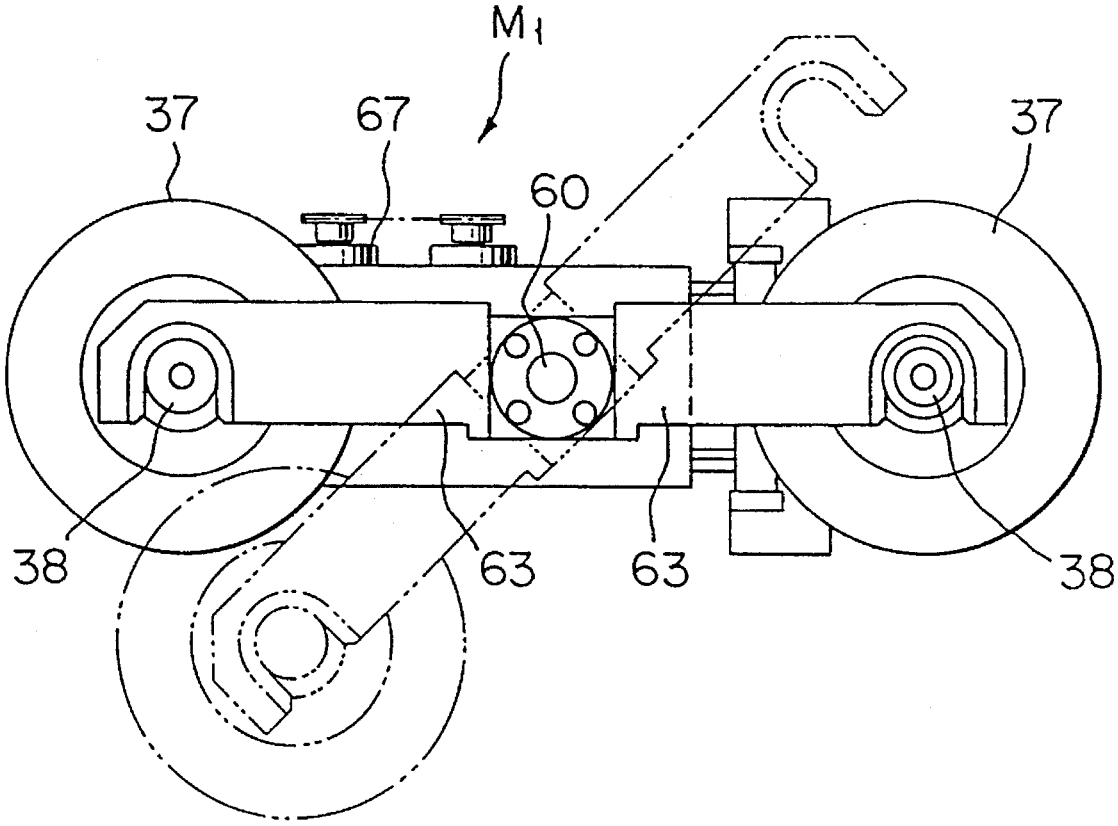
FIG. 11 is a plan view showing modified grinding wheel support arms in a modified grinding wheel magazine.
Figure 12:
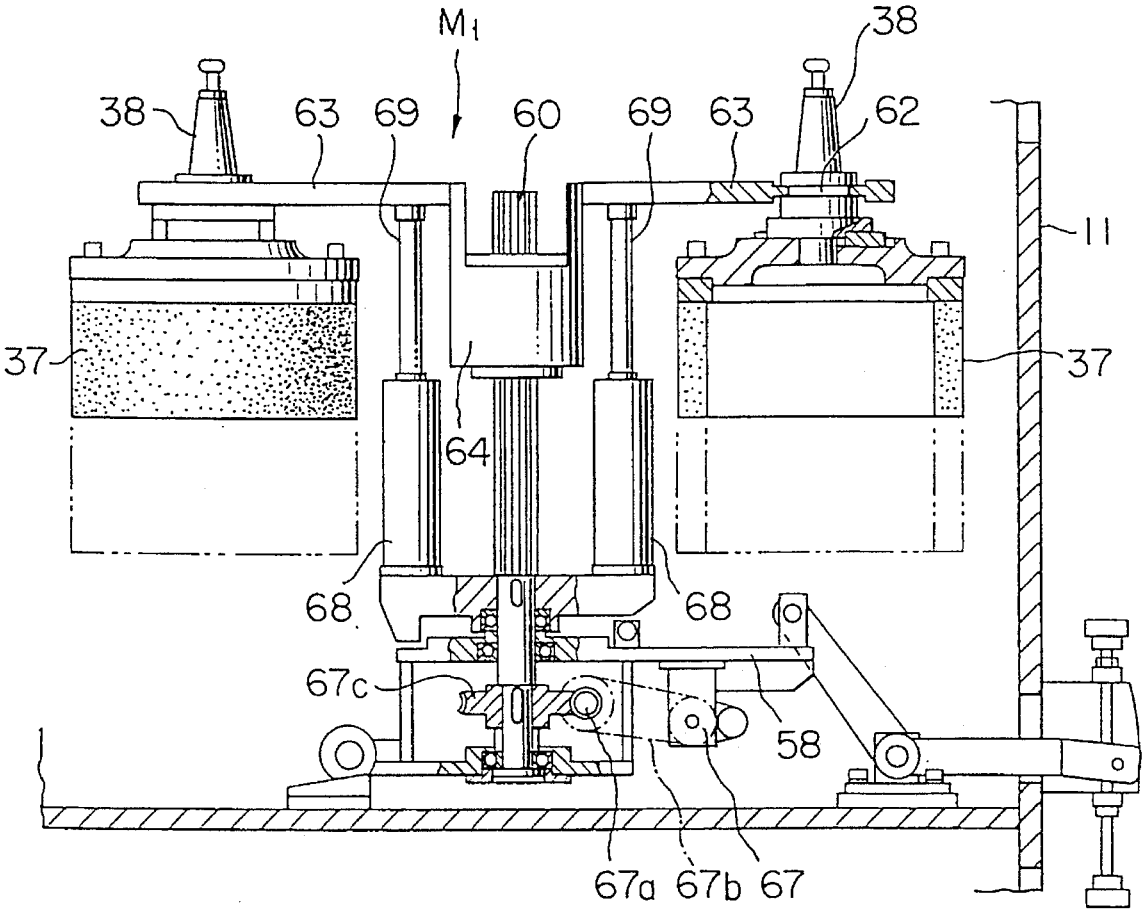
FIG. 12 is a vertical sectional view of the modified grinding wheel magazine of FIG. 11.

Referring next to FIGS. 11 and 12, there is shown another embodiment of the magazine mechanism. The magazine mechanism M1 comprises a rotational shaft 60 vertically supported in substantially the middle of the width of the bed 11 at one longitudinal end of the blade mount 44, a fluid-operated (pneumatic) cylinder or a shown vane type pneumatic rotary motor 67 whose rotation causes the rotation of the rotational shaft 60, and a slide member 64 slidably mounted on the rotational shaft 60 through a key or spline and including a support arms 63 having at their distal ends engagement portions, respectively. As shown in FIG. 12, rotation of the rotary motor 67 is transmitted to a worm 67*a* via a belt 67*b*, and the worm 67*a* causes a worm wheel 67*c* to rotate for the rotation of the rotational shaft 60. If, for example, four such support arms 63 are provided crosswise with respect to the rotational shaft 60, a magazine space for four grinding wheels 37 will be provided.

When the axis of the head stub shaft 38 of the grinding wheel 37 supported by the support arm 63 is brought into line with the axis of the rotational shaft 27 (FIG. 5) of the carriage 14 with the rotation of the rotational shaft 60, that is, when the grinding wheel 37 is to be attached or detached, rods 69 of pneumatic or hydraulic cylinders 68 are advanced or retracted to displace the support arms 63 vertically by a stroke, to thereby enable attachment and detachment of the grinding wheel 37 to and from the rotational shaft 27.

The magazine mechanism M has at a position along the rotational shaft 60 detectors 70 (FIGS. 1 and 9) for detecting the height of the grinding wheel 37. The detector 70 may be of a contact type such as a limit switch, or of a shown non-contact type (FIG. 9) using photoelectric tubes or ultrasonic waves. Although in this embodiment the detectors 70 are arranged at a height at which the grinding wheel 37 is changed, the position to detect the height of the grinding wheel 37 is not so limited. Therefore, for example, a vertically extending elongated detector may be placed within the magazine mechanism M to detect the height of the grinding wheel 37 at the time of storage, or the detectors may be placed on the lower end of the carriage 14 to detect the height of the grinding wheel 37 during the upward movement of the grinding wheel.

The operation of the knife grinding apparatus of the present invention will be described below.

The mounting plate 30 on the carriage 14 is first appropriately rotated to adjust the swing angle of the rotational shaft 27 mounted on the slide 20 with respect to the edge 4*a* of the blade 4. On the other hand, the blade 4 to be ground is fixedly mounted on the blade mount 44 whose blade 4 fixing plane is temporarily kept horizontal. In the shown example, as described above, the blade mount 44 is comprised of a magnet chuck body and the blade support 49 mounted on the magnet chuck body. The blade 4 is mounted on the blade support 49 with its obverse side directed upward (FIG. 3), and then the magnet chuck body is electrically excited to fix the blade 4.

Figure 6:
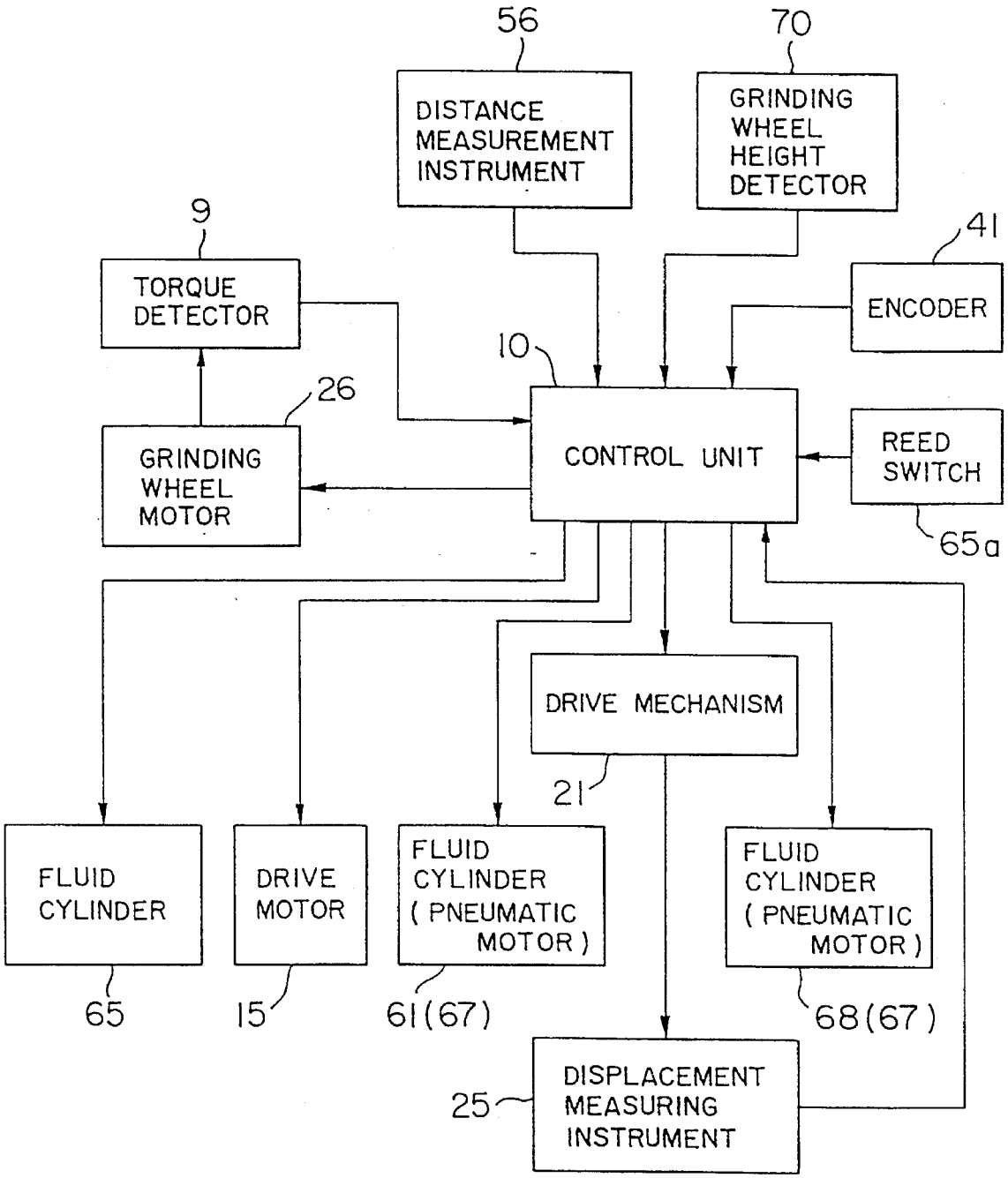
FIG. 6 is a block diagram showing a system for controlling the operation of the apparatus.

During these steps, the encoder 41 (FIGS. 5 and 6) for fitting control, upon detecting a predetermined rotational position of the rotational shaft 27, supplies a signal to a control unit 10 (FIG. 6) which causes the fluid cylinder 68 (FIG. 10) to extend upward, thereby raising the support arm 63 to fit the head stub shaft 38 of the grinding wheel 37 into the rotational shaft 27, while the carriage 14 is caused to travel to the position of the magazine mechanism M by means of the drive motor 15 (FIGS. 3 and 6) operated by a signal from the control unit 10 and the carriage 14 is brought to a temporary stop. Afterward, the support arm 63 storing a grinding wheel 37 of a coarse grade (hereinafter referred to as a coarse grinding wheel) is swung to the replacement position through the rotation of the rotational shaft 60 from the stand-by position by operating the fluid cylinder 61 (FIG. 10) or the vane type pneumatic motor 67 (FIG. 11), to thereby cause the axis of the head stub shaft 38 of the coarse grinding wheel 37 on the support arm 63 to coincide with the axis of the rotational shaft 27 of the carriage 14.

At the time when the two axes are coincident with each other, the fluid cylinder 68 is actuated by a signal from the control unit 10 to displace its rod 69 upward to thereby cause the head stub shaft 38 of the coarse grinding wheel 37 to slide into the interior of the rotational shaft 27, so that the top end of the head stub shaft 38 presses the linking rod 28 upward while being upwardly displaced within the opening of the rotational shaft 27. At that time, the linking rod 28 is subjected to an upward biasing force of the spring 35 which is however suppressed by the fluid pressure in the fluid cylinder 36 located thereabove. With the upward displacement, the head stub shaft 38 is caused to abut against the support ball 39 disposed at the lower end of the linking rod 29. Then the key 40 of the head stub shaft 38 is fitted into the key groove of the rotational shaft 27 to couple the head stub shaft 38 with the rotational shaft 27 in a manner known in the art.

The reed switches 65*a* (FIG. 9) serve to detect the attachment of the head stub shaft 38 to the rotational shaft 27 and cause the piston rod 66 of the fluid cylinder 65 (FIG. 9) to retract and release the head stub shaft 38 and then to cause the support arm 63 to return to its original position. In unison with this, the drive mechanism 21 (FIG. 4) is activated to displace the slide 20 upward. Simultaneously, the displacement measuring instrument 25 (FIG. 4) produces pulses the number of which is introduced into an operational circuit of the control unit 10 and the height of the bottom surface of the coarse grinding wheel 37 is detected by a non-contact type detector and the height of the coarse grinding wheel 37 is calculated. When reaching the upper limit, the coarse grinding wheel 37 comes to a stop.

Then, after the upper surface of the blade mount 44 has been temporarily kept horizontal by the drive of the motor 47, the blade 4 is fixedly mounted on the blade support 49 by electrically exciting the magnet chuck body. The magnet chuck body is then held at a desired angle by the motor 47 with the aid of the worm 46 and the worm wheel 45.

Under this condition, the motor 15 (FIG. 3) is energized by the control unit 10 to move the carriage 14 and the distance measuring instrument 56 on the carriage 14 to the area above the blade 4. Thus the distance from the initial position of the distance measuring instrument 56 to the upper surface of the blade 4 is measured at a plurality of predetermined positions including at least longitudinal ends of the blade 4, for example, at predetermined two ends only of the blade 4 or at predetermined three positions including the two ends and a substantially middle position, to thereby determine a minimum distance among these measured positions. After moving the carriage 14 to the position having the minimum distance, the relationship between the minimum distance and the height of the coarse grinding wheel 37 is operated in the operational circuit of the control unit 10 to determine a downward displacement of the coarse grinding wheel 37. In other words, the downward displacement is determined based on the vertical positional relation between the measurement origin of the distance measuring instrument 56 and the coarse grinding wheel 37 on the slide 20. If the measurement origin of the distance measuring instrument 56 coincides with the support base point for the coarse grinding wheel 37 on the slide 30 located at the upper limit, the amount of the downward displacement can be calculated by subtracting the actual height of the coarse grinding wheel 37 detected at the time of fitting the coarse grinding wheel 37 from the above minimum distance. Then, in response to the downward displacement obtained by the subtraction, the drive mechanism 21 is actuated to lower the slide 20 to position the coarse grinding wheel 37 at the grinding start level, and then a predetermined feed is imparted to the grinding wheel for every longitudinal stroke of the carriage 14 during the longitudinally reciprocating movement of the carriage 14.

In the actual operation, there arise inevitable errors, more or less, in the accuracy of the displacement measuring instrument 25 for detecting the actual height of the grinding wheel 37 and/or of the distance measuring instrument 56. These errors may accumulate to produce a positioning error in positive or negative direction from the grinding start level of the grinding wheel. Such error involves a risk that the coarse grinding wheel may undergo an idle grinding or may collide with the blade. Accordingly, the carriage 14 is moved by the motor 15 such that the axis of the rotational shaft 27 of the coarse grinding wheel 37 carried by the carriage 14 is positioned at the grinding start point, and then the coarse grinding wheel 37 is rapidly lowered by the drive mechanism 21 to the vicinity of the grinding start level, that is, to slightly above the level of the surface of the cutting edge 4*a* of the blade 4. Then, from that position the coarse grinding wheel 37 is further lowered at a lower speed to abut against the surface of the cutting edge 4*a*.

An amount of torque (a certain load causing a change in the rated current in the motor 26 for the grinding wheel 37) is produced at the time of the abutment, and an abutment signal is supplied from a torque detector 9 (FIG. 6) to the control unit 10. Then, the control unit 10 supplies a signal to the drive mechanism 21 to operate it reversely, and the coarse grinding wheel 37 is raised by a small, first predetermined distance. The height position of the grinding wheel 37 thus raised by that distance is now determined as an "abutment height position" and set in the control unit 10. The grinding wheel 37 and the blade 4 have a small resiliency, and even if a signal for stopping the lowering movement of the grinding wheel is issued concurrently with the detection of the abutment of the grinding wheel with the blade edge, the grinding wheel will continue its lowering movement due to the inertia with both the grinding wheel and the blade being resiliently deformed to a small degree so that there will be a difference between the position at which the abutment first occurs and the position which the grinding wheel reaches. The slightly raised "abutment height position" referred to above can therefore be deemed a real abutment position. The drive mechanism 21 is then operated under the control of the control unit 10 to further slightly raise the grinding wheel 37 by a second predetermined small distance to securely avoid interference of the grinding wheel with the blade. The carriage 14 is then moved to the grinding start position above one end of the longitudinal direction of the blade 4, and afterward the carriage 14 is longitudinally reciprocated while being given a predetermined feed into the blade 4 for one stroke of the carriage 14. In practice, the raising of the grinding wheel by the first and second distances may be carried out simultaneously.

Before the start of the blade grinding, the back surface of the blade 4 mounted on the blade support 49 presses the valve member 52 (FIG. 8) downward to open the conduits 50, to thereby allow the cooling medium to be supplied into the spaces between the flat support bars 48 and to the back of the blade 4. On the contrary, the front of the blade 4 is supplied with the cooling medium through the respective flexible tubes. Under these conditions, the motor 26 (FIG. 5) is activated to transmit its rotational force through the belt 34 to the rotational shaft 27 to thereby rotate the coarse grinding wheel 37. The forward or backward reciprocating movement of the carriage 14 with the rotation of the grinding wheel 37 in this manner enables the blade 4 to be ground while removing heat produced by the grinding by the cooling medium.

After unevenness, cutouts and the like on the surface of the cutting edge 4*a* of the blade 4 have been removed with the grinding of this coarse grinding wheel 37, the carriage 14 is moved to the replacement position where the coarse grinding wheel 37 is replaced with a grinding wheel 37 of a finer grade (hereinafter referred to as a medium grinding wheel). More specifically, when the carriage 14 is moved to the replacement position and the coarse grinding wheel 37 is lowered to a lower limit by means of the drive mechanism 21, the vacant support arm 63 (FIG. 9) for the coarse grinding wheel is rotated in the opposite direction to that mentioned before for engagement with the annular groove 62 (FIG. 10) of the head stub shaft 38. At the time of this engagement, the rod 66 (FIG. 9) of the fluid cylinder 65 with the reed switches 65*a* is extended to lock the head stub shaft 38 in the support arm 63, and the fluid cylinder 36 (FIG. 5) is actuated to press down the linking rod 28 with its piston rod. Then, the support ball 39 located below the linking rod 28 is lowered to release the support of the top of the head stub shaft 38 and to allow the coarse grinding wheel 37 to be transferred into the vacant support arm 63. Afterward, the support arm 63 is rotated to return to its original position. Then, the support arm 63 for the medium grinding wheel is operated in the same manner as stated before to fit the medium grinding wheel 37 into the rotational shaft 27.

While the slide 20 is being moved upward and approaching its upper limit with the rotational shaft 27 fitted with the medium grinding wheel 37, the actual height of the medium grinding wheel 37 is detected in the same manner as mentioned before. On the other hand, for the purpose of measuring the distance to the blade 4 which has been ground by the coarse grinding wheel 37, the motor 15 (FIG. 3) is activated to move the distance measuring instrument 56 (FIG. 4) mounted on the carriage 14 along the blade 4 to thereby measure the distance from the initial position of the distance measuring instrument 56 to the top surface of the blade 4. In this case, the measurement at least at a single position in the longitudinal direction is sufficient since the flatness of the blade 4 is ensured by the coarse grinding wheel 37. Then the actual height of the medium grinding wheel 37 which has been detected at the time of fitting the medium grinding wheel 37 is subtracted from the obtained measured distance to find a downward displacement. Then, the medium grinding wheel is lowered in the same manner as stated before by the thus obtained downward displacement to initiate the grinding.

The grinding by the use of the coarse grinding wheel is effective, particularly, in the case where unevenness, cutouts and so on on the edge face of the blade is to be removed, that is, where the amount to be ground is great. In this embodiment, the amount of feed is of the order of 0.02 mm. On the other hand, the grinding by the use of the medium grinding wheel 37 is effective, particularly, in the case when surface roughness and striped chipping remaining on the edge face are to be removed after the edge surface has become flat by the course grinding wheel. In this embodiment, the amount of feed for the medium grinding wheel 37 is of the order to 0.005 mm which is less than that for the coarse grinding wheel 37 described above.

Figure 28:
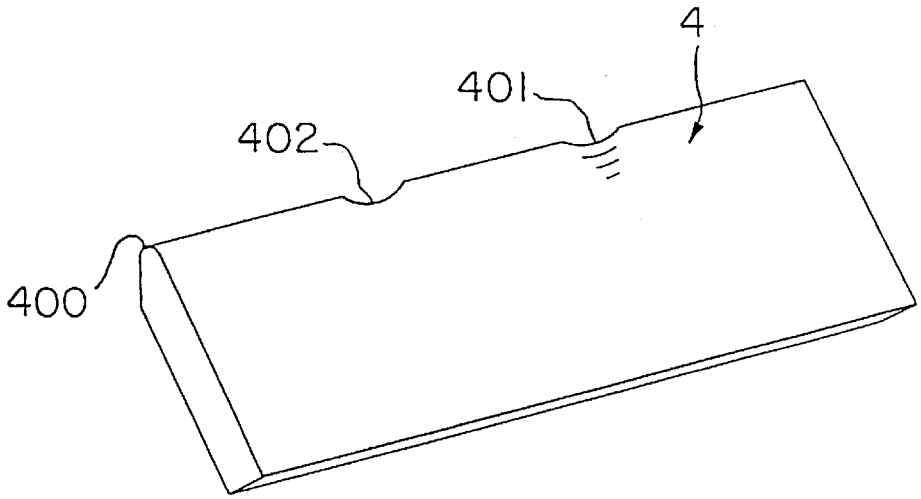
FIG. 28 is a perspective view of a knife blade having a dull edge, cutout and local laterally deformed portion.

The cutting edge 4*a* of the blade 4 is as shown in FIG. 1 before it is attached to a veneer lathe or veneer slicer. However, after the blade is used, the cutting edge 4*a* undergoes wear and becomes blunt entirely or locally as shown at 400 in FIG. 28. Furthermore, while the blade is used, the cutting edge tends to be laterally bent or deformed locally as indicated at 401 in FIG. 28 when the edge is hit by a hard knot, knar or knob on the log during the cutting operation. Moreover, when the edge bites a foreign object such as a sand particle or a small metal piece during the cutting operation, the cutting edge will be formed a cutout as indicated at 402 in FIG. 28. If the damages to the cutting edges as mentioned above are produced, they must be eliminated for the next cutting operation by the blade.

It has been a practice heretofore that in the case of a local lateral deformation 401 the cutting edge is hammered laterally in the direction opposite to the lateral deformation to make the edge line approximately straight and then the cutting edge is entirely ground to a considerable degree until an exactly straight edge line is generated. In the case where a blunt edge 400 or a cutout 402 is formed, it has been a practice to remove the cutting edge by grinding to the point A in FIG. 29(*a*) to leave only the hatched portion. Thus the point A becomes a new edge line.

Figures 29A, 29B, 29C:
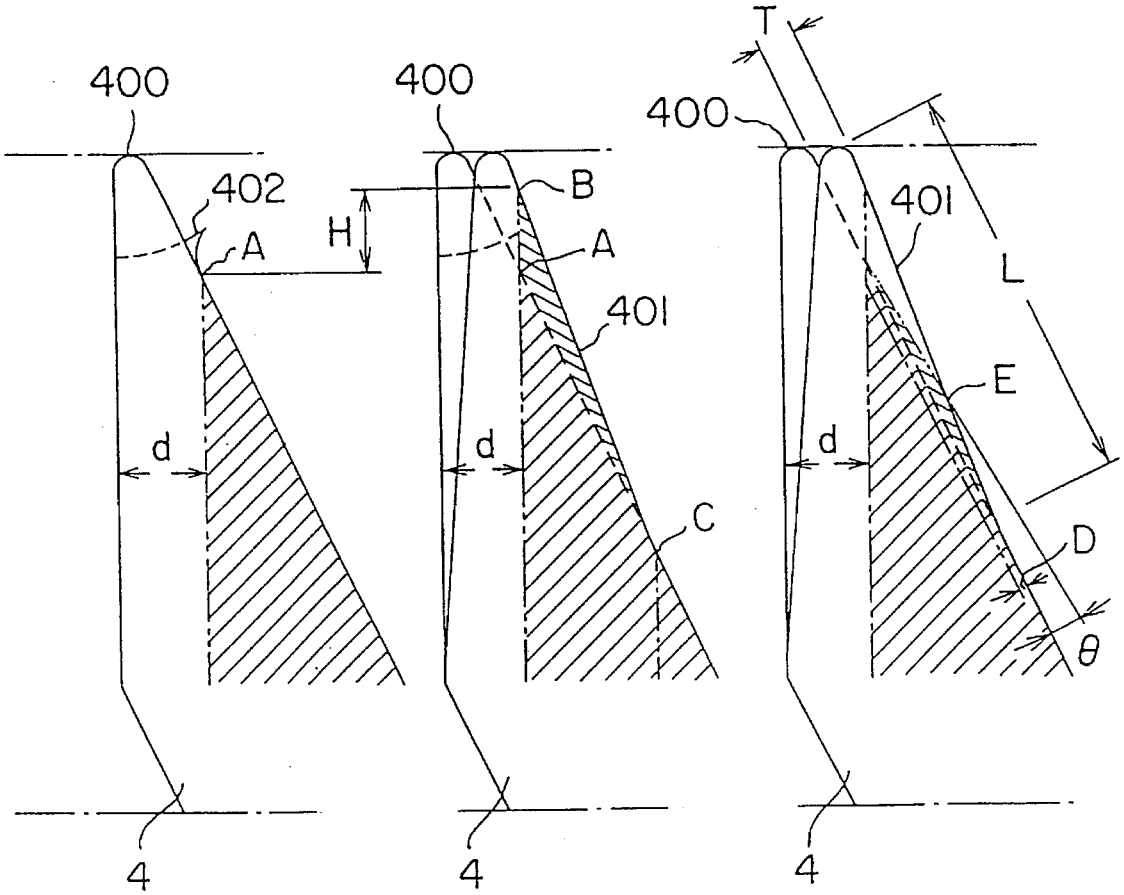
FIGS. 29(*a*), 29(*b*) and 29 (*c*) are three views used for comparison of three different grinding operations for removing the dull edge, cutout and deformed portion shown in FIG. 28.

In the case of a local lateral deformation 401, however, the measure taken for eliminating a blunt edge 400 or a cutout 402 is not effective. As shown in FIG. 29(*b*), even if the same depth d of the blade material is removed by grinding to the point B, the local lateral deformation 401 cannot be removed. There is a difference H between the points A and B and the edge line cannot be made straight. Therefore, in order to reproduce a straight cutting edge, it is necessary either to hammer the laterally deformed portion 401 to the opposite side and then apply the grinding operation as done heretofore or to remove the blade material by grinding to a larger depth to the point C as shown in FIG. 29(*b*). It should be noted that the former measure is not advantageous because minute depressions remain on the edge surface as a result of the hammering, which produce an adverse influence on the quality of the surface of the peeled off veneer. It should also be noted that the latter measure is not advantageous in that too much blade material must be removed and the operation is time-consuming.

The above stated disadvantages can be eliminated by taking a measure shown in FIG. 29(*e*). That is to say, the laterally deformed portion 401 is removed by applying a grinding operation to the back surface of the cutting edge. The grinding operation may be carried out at an angle θ to the major back surface of the cutting edge that is free from the laterally deformed portion 401, whereby a part of the laterally deformed portion 401 is removed from the tip to the point E. By doing so, removal of the blade material on the front side by the depth d becomes sufficient to produce a new straight edge line as clearly indicated in FIG. 29(*c*).

Figure 23:
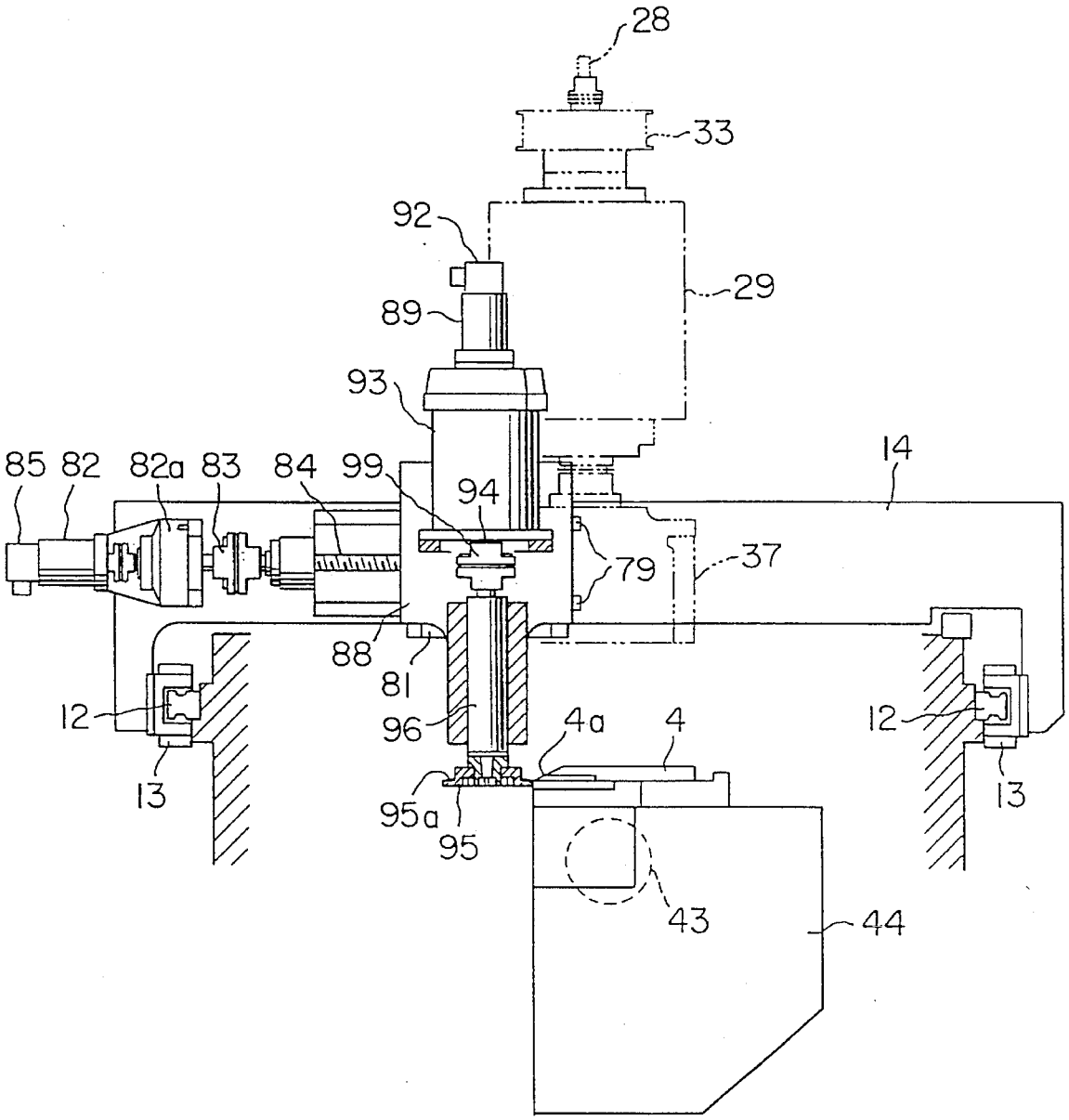
FIG. 23 is a view similar to FIG. 3 but showing an apparatus for grinding the back side of the knife blade.
Figure 24:
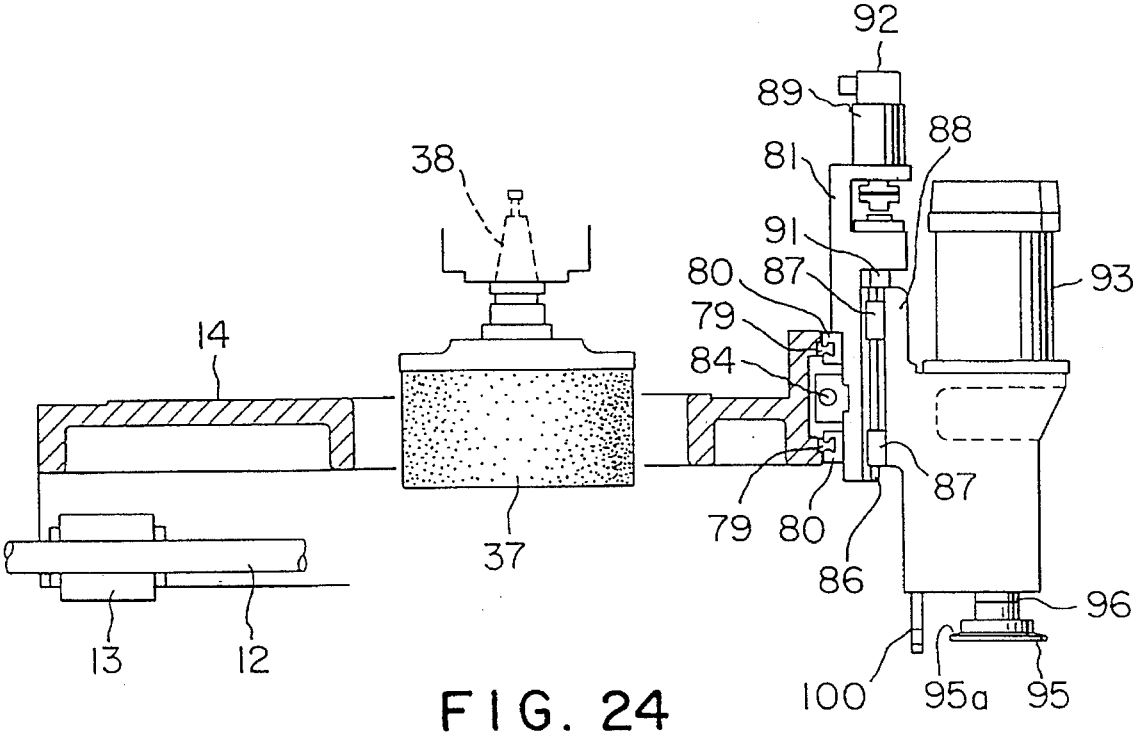
FIG. 24 is a view, partly in section, as seen from the right side of FIG. 23.
Figure 25:
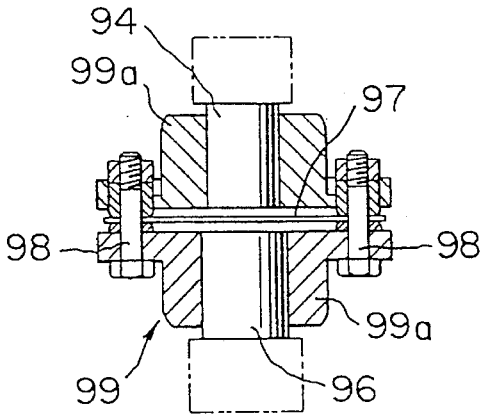
FIG. 25 is a sectional-view of a resilient coupling.

FIGS. 23 through 27 show an embodiment of an apparatus for carrying out the grinding on the back surface the cutting edge 4*a* in the manner shown in of FIG. 29. As indicated in FIG. 23, a pair of horizontal guide means 79 are provided on one of the side surfaces of the carriage 14 with respect to the lengthwise direction of the bed 11. The guide means 79 may take the form of guide grooves of a dovetail cross section or other cross sections. Sliding blocks 80 are mounted slidably on the guide means 79. A horizontal slide 81 is fixedly mounted on the sliding blocks 80 so that the slide 81 is capable of horizontal shifting movement. A horizontal feed motor 82, such as an AC rotary servomotor shown or a fluid cylinder, is connected to a speed reducer 82*a* which in turn is connected via a coupling 83 for preventing backlash to a feed screw 84 such as a ball screw. The feed screw 84 is in screw-engagement with a nut fixed to the slide 81. A displacement measuring instrument 85 is associated with the feed motor 82. The measuring instrument 85 is, for example, an encoder for issuing pulses depending upon the rotation of the feed screw 84 in positive and negative directions.

Vertical guide means 86 are provided on the slide 81 and sliding blocks 87 are slidably mounted on the guide means 86. A vertical slide 88 are fixedly mounted on the sliding blocks 87 so that the slide 81 can move vertically. A vertical feed motor 89 mounted on the slide 81 is connected to a feed screw 91 that is in screw-engagement with a nut fixed to the slide 88, whereby the feed motor 89 can move the slide 88 vertically. A displacement measuring instrument 92 is associated with the feed motor 89 and detects the amount of rotation in positive and negative directions as in the case of the displacement measuring instrument 85.

On the vertical slide 88 is fixedly mounted a rotary motor 93 for driving a grinding wheel 95 used to grind the back surface of the cutting edge 4*a* of the blade 4. The motor 93 has a shaft 94 connected to a spindle 96 of the grinding wheel 95 via a resilient coupling 99. The resilient coupling 99 is shown in detail in FIG. 25 and includes an intervening elastic plates 97 that are mutually pin-connected and are respectively connected to the coupling halves by means of bolts 98.

Figure 26:
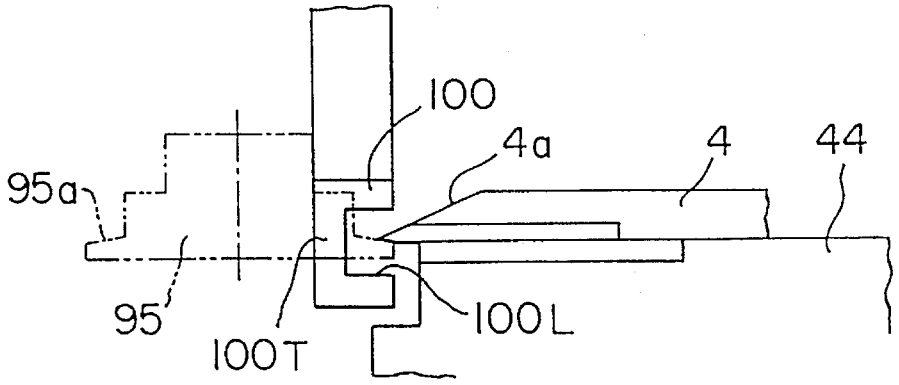
FIG. 26 is a view illustrating the relation between the knife blade and a laser-type detector.

The control of the horizontal feed motor 82 for the horizontal slide 81 and of the vertical feed motor 89 for the vertical slide 88 are carried out on the basis of the position of the cutting edge of the blade 4 and the shape of the local lateral deformed portion 401. The position of the cutting edge and the shape of the deformed portion 401 are detected by either a contact-type detector such as a limit switch, or a non-contact type detector such as a photoelectric or ultrasonic detector. In the embodiment shown, a known U-shaped laser-type detector 100 (FIGS. 24 and 26) is used. The detector 100 is positioned adjacent to the grinding wheel 95 and has a laterally open space into which the cutting edge 4*a* of the blade is received as indicated in FIG. 26. The height T of the deformed portion 401, shown in (c) of FIG. 29, is detected by a vertical section 100T (FIG. 26) of the detector 100, and the length L of the deformed portion 401, shown in (c) of FIG. 29, is detected by a horizontal section 100H (FIG. 26) of the detector 100.

Although the laterally deformed portion 401 is detected in terms of its height T and the length L in the embodiment of FIG. 26, either one of the height and the length may be detected for the purpose of detecting the shape of the deformed portion 401. The laser-type detector 100 may be divided into two separate units corresponding to the vertical and horizontal sections T and 2, respectively, and disposed at different positions.

Figure 27:
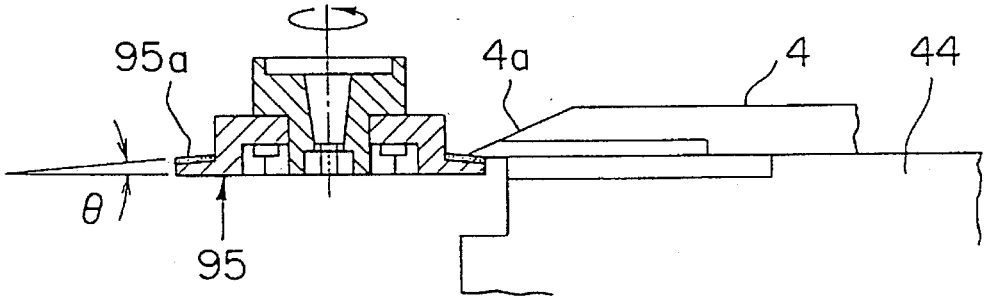
FIG. 27 is a view showing the relation between the knife blade and a back side grinding wheel.

As shown in FIG. 27, the grinding wheel 95 for grinding the back surface of the cutting edge 4*a* has an upwardly facing, annular grinding surface 95*a* that may be of a slightly conical shape. That is, as viewed in FIG. 27, the grinding surface 95*a* gradually slopes downward as it extends radially outward.

A blade 4 having a local laterally deformed portion 401 at the back side of the cutting edge 4*a* is ground by the grinding wheel 95. The grinding of the back side of the cutting edge 4*a* may be performed either prior to or after the grinding of the front side of the cutting edge. However, for purposes of explanation, a grinding of the back side after the front side will be described below.

A blade 4 immediately after the front side grinding is fixedly mounted horizontally on the magnet chuck mount 44, as indicated in FIG. 23, with the front side of the cutting edge 4*a* facing upward, and the carriage 14 is at a waiting position above the blade 4. In this state, the motor 47 (FIG. 2) is operated to rotate the horizontal shaft 43 via the worm 46 and worm wheel 45 so as to adjust the blade mount 44 to such an attitude as to cause the back surface of the cutting edge 4*a* to assume an exactly horizontal attitude, while the motor 15 (FIG. 3) is operated to move the carriage 14 to a position above one longitudinal end of the blade 4.

Thereafter, the horizontal feed motor 82 is operated to rotate the feed screw 84 so as to shift the horizontal slide 81 to the right as viewed in FIG. 23 toward the cutting edge 4*a*. When the edge line of the cutting edge 4*a* is detected by the detector 100, the shifting movement of the horizontal slide 81 is stopped. Then, the vertical feed motor 89 is operated to rotate the feed screw 91 so as to vertically shift the vertical slide 88. The slide 88 is raised or lowered to shift the detector 100 to a position confronting the cutting edge 4*a* as indicated in FIG. 26. In this state, the motor 15 is operated to cause the carrier 14 to make a longitudinal stroke along the blade 4. During this stroke, the height T of a local laterally deformed portion 401, if any, is detected by means of the vertical section 100T of the detector, and the length L of the-portion 401 is detected by means of the horizontal section 100L of the detector. If there are a plurality of laterally deformed portions 401 on the cutting edge, a largest detected height T is selected and inputted to the control unit.

Upon completion of the longitudinal stroke of the carrier 14, the vertical feed screw 91 is rotated by the vertical feed motor 89 to adjust the vertical position of the vertical slide 88 by an amount corresponding to the detected largest height T of the laterally deformed portions 401, in such a manner as to position the upper grinding surface 95*a* of the grinding wheel 95 at a distance T from and below the back surface of the cutting edge of the blade mounted on the blade mount 44. Thereafter, the grinding wheel 95 is fed upward by the vertical feed motor 89 by an amount equivalent to the amount of cut, while the grinding wheel 95 is stroked longitudinally of the blade 4 from its one end to the other with the grinding surface 95*a* maintained parallel to the back surface of the cutting edge 4*a*. The feeding and stroking operation is continued until the laterally deformed portions 401 are completely removed and the back surface of the cutting edge becomes smooth and level, in such a manner that the grinding wheel 95 is lifted a predetermined amount for each longitudinal stroke of the wheel and/or is horizontally advanced a predetermined distance toward the proximal edge of the blade by means of the horizontal feed motor 82 for each longitudinal stroke of the wheel. Since the grinding surface 95*a* is maintained parallel to the back surface of the cutting edge during the grinding operation, a minute shoulder of a depth D may remain as indicated in (c) of FIG. 29 after completion of the grinding operation for removing the laterally deformed portion 401, but this does not cause a problem because the shoulder will be eliminated in the next grinding operation.

The grinding operation described above is carried out with the grinding surface 95*a* maintained parallel with the back surface of the cutting edge. However, the grinding operation may be carried out with the grinding surface 95*a* maintained at an angle θ relative to the back surface of the cutting edge, as indicated in (c) of FIG. 29.

In this case, after laterally deformed portions 401 are detected, the horizontal shaft 43 is rotated counterclockwise as viewed in FIG. 23 so that the upper mounting surface of the blade mount 44 will make a small angle relative to the horizontal in such a manner that the cutting edge is slightly inclined downward toward the left side in the figure. Thereafter, in the same manner as described above, the grinding wheel 95 is fed upward by a predetermined amount and stroked longitudinally of the blade cutting edge, and this operation is repeated until the laterally deformed portions 401 are removed completely. This repeated operation may be accompanied by an advancing feed of the grinding wheel 95 toward the proximal edge of the blade. Since the grinding surface 95*a* acts on the back surface of the cutting edge at an angle θ, a small sloping surface E will remain on the back surface as shown in FIG. 29(*c*) in a region where the laterally deformed portion 401 existed. However, the sloping surface E will be removed in the next grinding operation and there will be no problem.

Instead of incliningly adjusting the upper mounting surface of the blade mount 44 to make an angle θ to the horizontal, the upper grinding surface 95*a* may be provided to form an angle θ to the horizontal as indicated in FIG. 27. Such arrangement will provide the same result of grinding as described above. Back side grinding wheels 95 may be provided in series in the longitudinal direction of the bed 11. Or another support arm like the support arm 63 shown in FIG. 9 may additionally be provided in a relation crossing the support arm 63 so as to enable automatic change of the back side grinding wheel 95 in the same manner as the front side grinding wheel 37.

Though not shown in FIG. 5, flexible tubes or the like may be appropriately connected to the rotational shaft 27 so as to communicate with the hollow thereof. By this measure, at the time of replacement with a grinding wheel 37 of a different degree, a fluid such as compressed air or a cleaning liquid can be supplied through the interior of the hollow to remove the abrasive particles and grinding dust adhering to the rotational shaft 27, the grinding wheel 37 and so on. This ensures a satisfactory condition for grinding. In case a desired flatness is lost due to abrasion or damage of the mounting surface of the blade mount 44 during the grinding operation, the grinding wheel 37 may be brought into contact with the blade mount 44 without a blade 4 mounted thereon, and the carriage 14 may be reciprocated while rotating the grinding wheel 37. Thus, the flatness of the blade mount 44 can be maintained.

The grinding wheel 95 used for grinding the back side of the blade 4 to ordinarily remove a ridge angle (for example, of an elongated blade 4 to be used in a wood slicer) differs in hardness, grading and so on from the grinding wheel 37 exclusively used for grinding the front side of the blade. Therefore, the back side of the blade cutting edge is usually ground after replacement of the grinding wheel 37 within the magazine mechanism M by another grinding wheel after grinding blades 4 in one lot. Further, as described before, a plurality of grinding wheels 95 exclusively used to grind the back side of the blade cutting edge may be arranged in series in the direction of the length of the bed 11, separately from the grinding wheels for the front side of the blade cutting edge.

Figure 13:
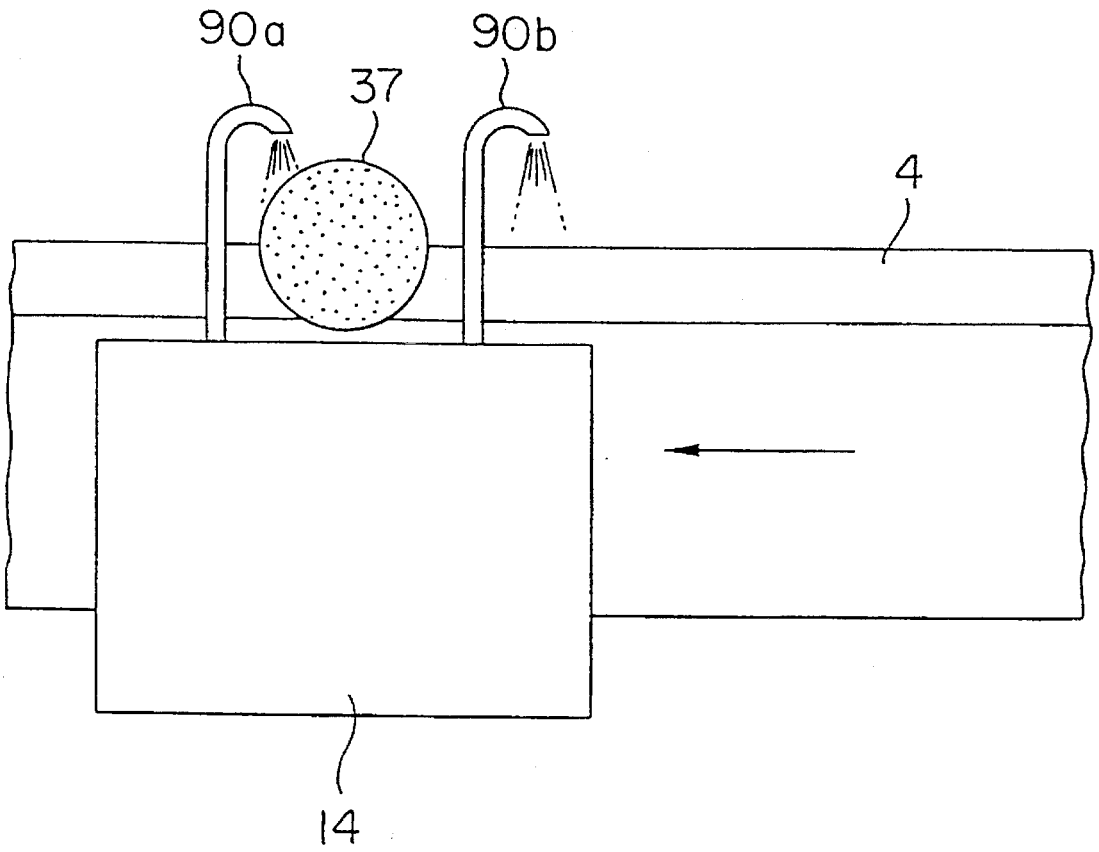
FIG. 13 is a fragmentary elevation of a carriage with cooling medium supply tubes.

While FIGS. 7 and 8 illustrate an example for removing heat generated by the grinding through a supply of the cooling medium to the blade 4, the supply of the cooling medium during the grinding of the blade 4 may be performed as illustrated in FIG. 13 by way of a first flexible tube 90*a* for supplying a cooling medium such as cooling water, oil, compressed air to both the grinding wheel 37 (95) and the blade 4, and a second flexible tube 90*b* arranged behind the first flexible tube 90*a* in the running direction thereof. Thus, the carriage 14 may be moved forward and backward while the cooling medium is being supplied via the first and the second flexible tubes 90*a* and 90*b*. In this example, upon grinding the blade 4, the grinding wheel 37 (95) and the edge 4*a* of the blade 4 are supplied with the cooling medium through the first flexible tube 90*a*, while immediately after the grinding, the part of the blade 4 is supplied with the cooling medium through the second flexible tube 90*b* to thereby prevent heat from being generated by the grinding.

FIGS. 14 to 20 illustrate other embodiments for supplying a cooling medium for the elimination of the heat generated by the grinding. The mounting of the blade 4 to the blade mount 44 in these embodiments is carried out by means of blade pressers screwed to the blade mount 44.

Figure 14:
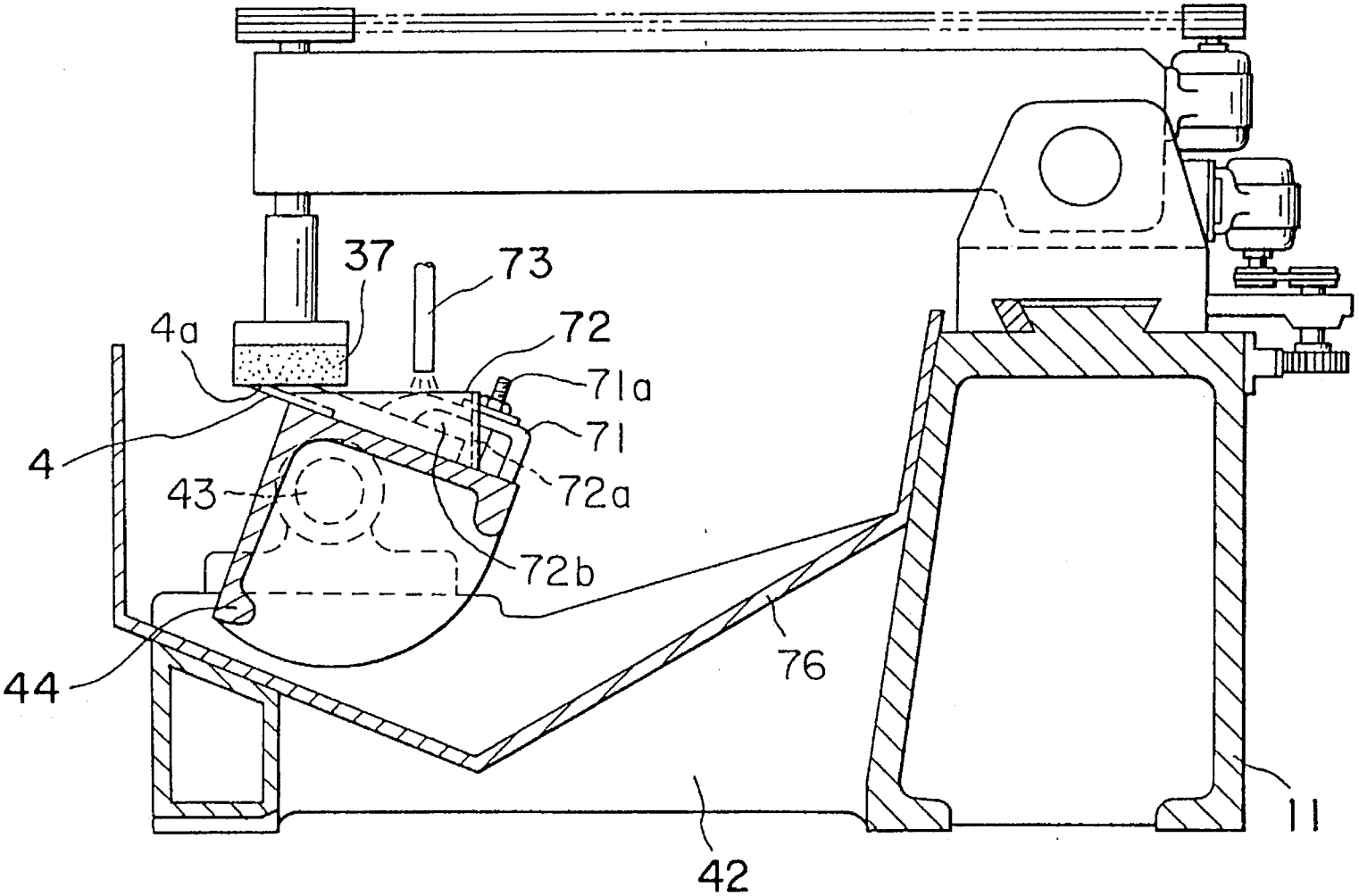
FIG. 14 is a side view, in vertical section and with some elements removed, of a knife blade cooling device.

Referring to FIG. 14, adjacent to a bed 11 is shown a blade mount 44 rotatably supported on a horizontal supporting shaft 43. On the top surface of the mount 44, an elongated blade 4 is mounted and fixed by means of blade pressers 71 and a cooling medium reservoir 72 encompasses the entire blade 4. When grinding the blade 4, the reservoir 72 is fed with a cooling medium through a flexible tube 73. Below the blade mount 44 there is provided a liquid receiver 76. In FIG. 14, the top surface of the blade mount 44 is so inclined that the edge of the blade 4 mounted thereon is directed obliquely upward to a small degree. Because the reservoir 72 may cover only a region toward the cutting edge of the blade 4 in this case, the blade 4 may be enclosed along its longitudinal edge opposite the cutting edge by a wall 72*a* and adjacent to its longitudinal ends by side walls 72*b* of the reservoir 72 into which is supplied the cooling medium. The pressers 71 are fixed by screws 71*a*. Thus, a major portion of the major surface of the blade 4 is cooled by the cooling medium.

Figure 15:
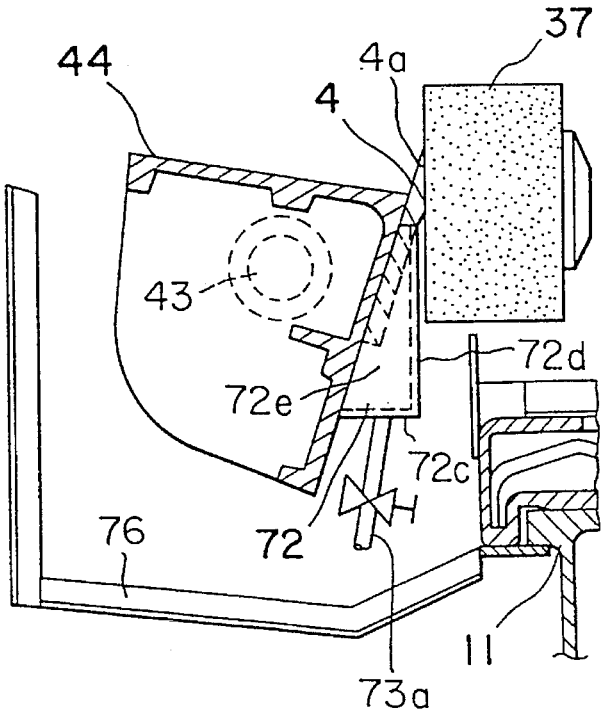
FIG. 15 is a view showing a modification of the cooling device of FIG. 14.

Referring next to FIG. 15, there is shown a reservoir 72 provided on the front or side surface of the blade mount 44 and accommodating the entirety of the blade 4. The reservoir has a bottom wall 72*c*, a front wall 72*d* and a pair of opposite side walls 72*e*. The reservoir 72 is supplied with a cooling medium from above via a flexible tube in the same manner as shown in FIG. 14, or from below via a flexible tube 73*a* as shown in FIG. 15. In this example, also, there is provided a liquid receiver 76 below the blade mount 44. In case the cooling medium in the reservoir 72 absorbs heat generated by the grinding and is rapidly warmed up, it is preferable that the cooling medium be at all times supplied into the reservoir 72 so as to overflow and be prevented from increasing in temperature. In the example shown in FIG. 15, the blade 4 is obliquely upwardly directed on the front surface of the blade mount 44 so as to be ground by a grinding wheel 37 from the lateral side.

Figure 16:
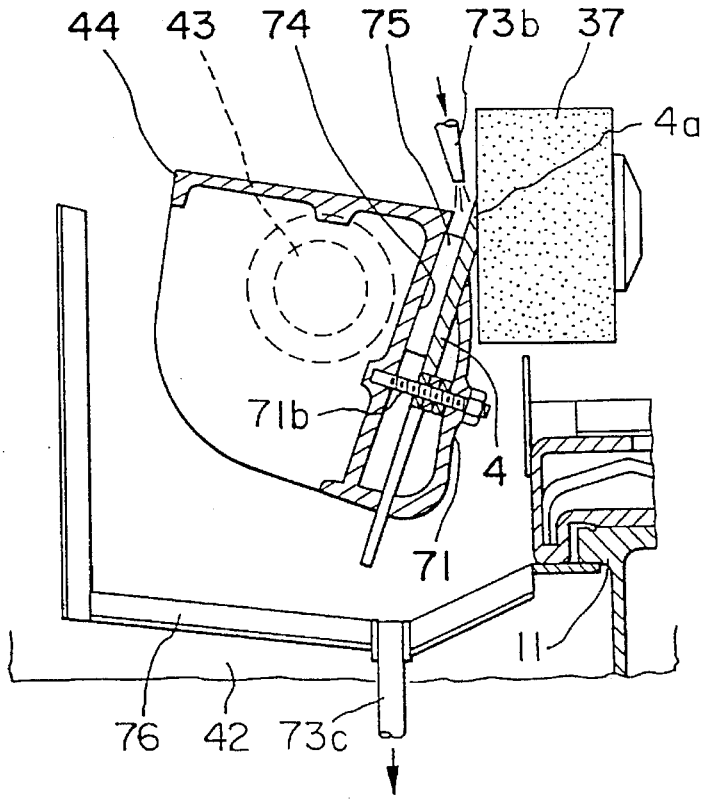
FIG. 16 is a view showing another modification of the cooling device.

Referring further to FIG. 16, there is shown a blade mount 44 including a flat front surface 74 having thereon a plurality of spaced vertical ribs 75 whose front surfaces cooperate to serve as supporting means for the back of the blade 4 so as to maintain a longitudinal parallelism of the blade 4 with the front surface 74. The spaces formed between adjacent ribs 75 confront respectively a plurality of nozzles **73*b* connected to a flexible tube for the supply of a cooling medium. Through the nozzles 73*b*, the cooling medium is ejected onto the blade 4, the front surface 74 of the blade mount 44, and the ribs 75. Between a bed 11 and a frame 42 extends a cooling medium receiver 76 along the entire length of the blade mount 44. The cooling medium which has been received by the receiver 76 is circulated through a bottom tube 73*c* and a cooling device and returned into the nozzles 73*b*. Although each of the ribs 75 in the shown example is continuous, they may be formed intermittent, that is, vertically divided into a plurality of pieces. The blade 4 is fixedly mounted on the blade mount 44 by means of screw fixing type blade pressers 71. Screws are shown at 71*b***.

Figure 17:
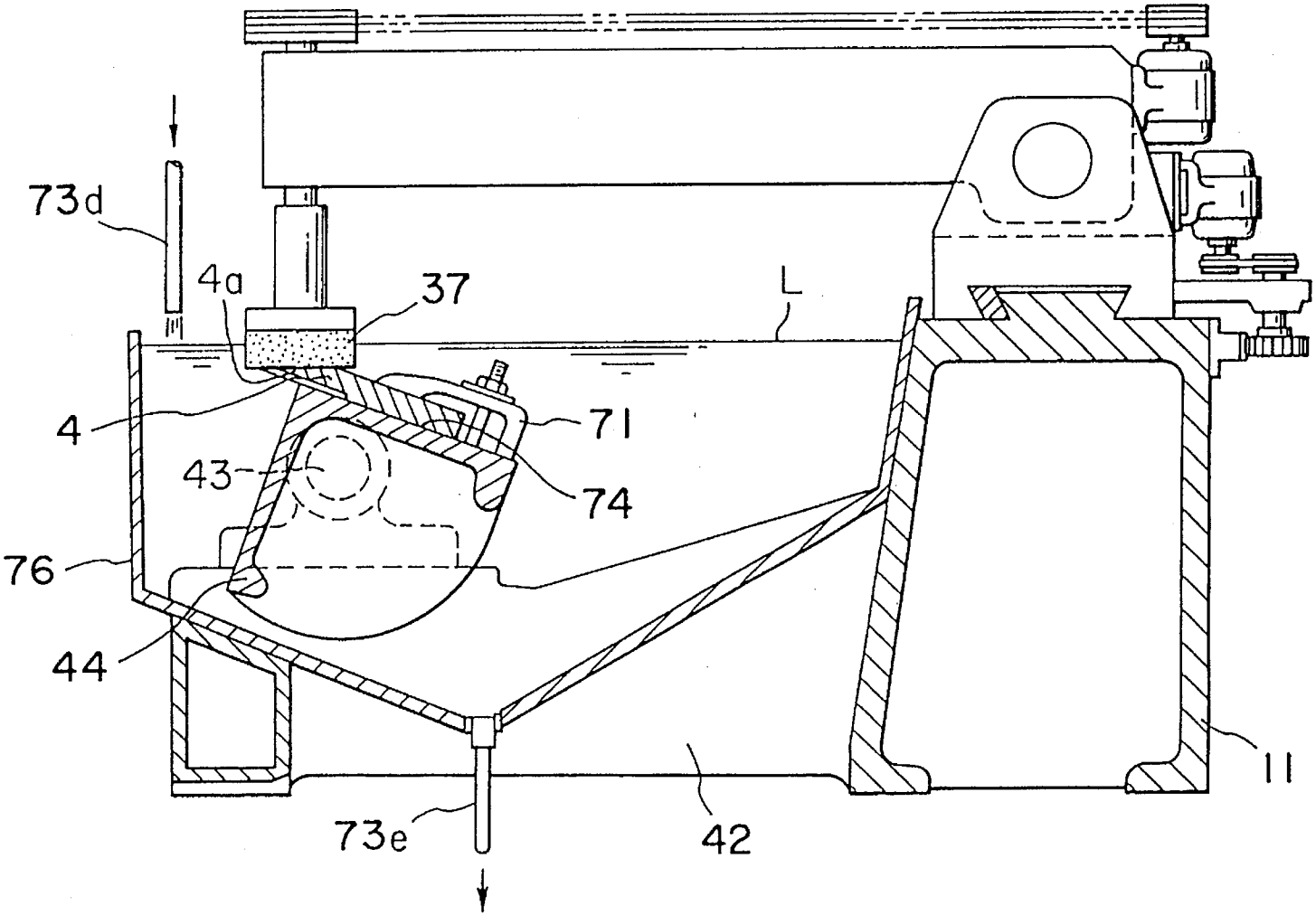
FIG. 17 is a view showing a further modification of the cooling device.

Referring to FIG. 17, there is shown a cooling medium receiver 76 provided between a bed 11 and a frame 42 and extending along the entire length of a blade mount 44. In this example, a cooling medium to be circulated via a cooling device is charged into or discharged from the receiver 76 by way of a flexible tube **73*d* and a flexible tube 73*e*, respectively, while the level L of the cooling medium is maintained substantially equal to that of the top of the blade 4. It is to be noted that in this case a flat top surface 74 of the blade mount 44 may have an opening in which is fitted a lattice member or a reinforcing member in the form of a framework. The top surface 74 serves as a support for the back of the blade 4 over its longitudinal extent, to thereby cause the cooling medium to be supplied directly into the back of the blade 4. In case the cooling medium to be charged or discharged tends to be stagnant within the receiver 76 to cause a non-uniform temperature distribution along the longitudinal and vertical directions of the blade 4, stirring devices not shown may be provided in the receiver 76** at appropriate positions so as to stir the cooling medium to maintain the temperature substantially uniform.

Figure 18:
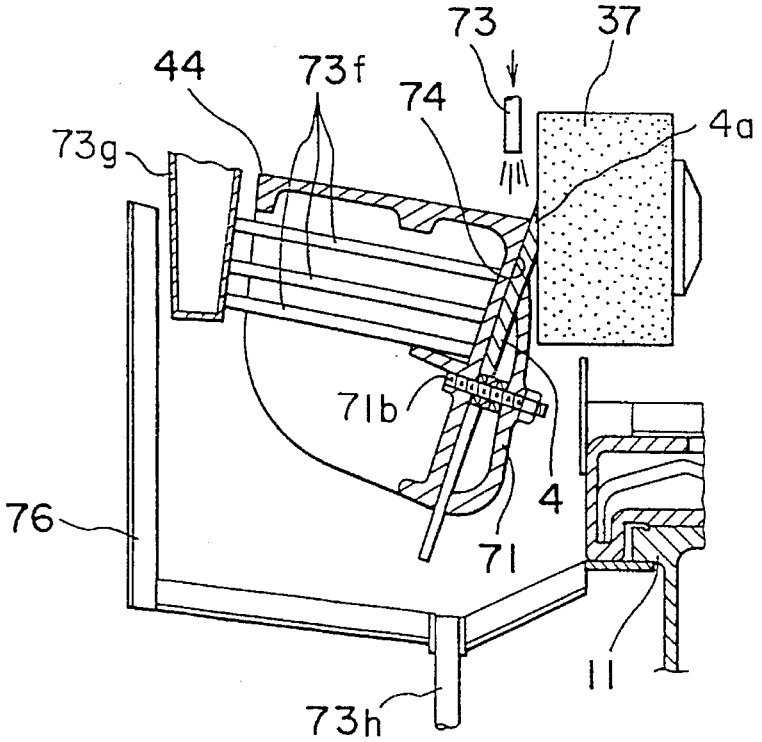
FIG. 18 is a view showing a still further modification of the cooling device.

Referring to FIG. 18, there is shown a blade mount 44 including a flat front surface 74 formed of a metal having a high thermal conductivity such as copper or aluminum. In this example, a plurality of flexible pipes **73*f* are arranged for leading a cooling medium to the outer side of the front surface 74 of the blade mount 44. The flexible pipes 73*f* permit angular adjustment of the blade mount 44. Further, a receiver 76 extends below the mount 44 along the entire length of the head 44. The receiver 76 has a bottom discharge tube 73*h* from which the cooling medium is supplied into a header 73*g*, and then into the flexible pipe 73*f*. Pressers are shown at 71. In addition, a cooling medium supply tube 73 is provided above the blade 4**.

Figure 19:
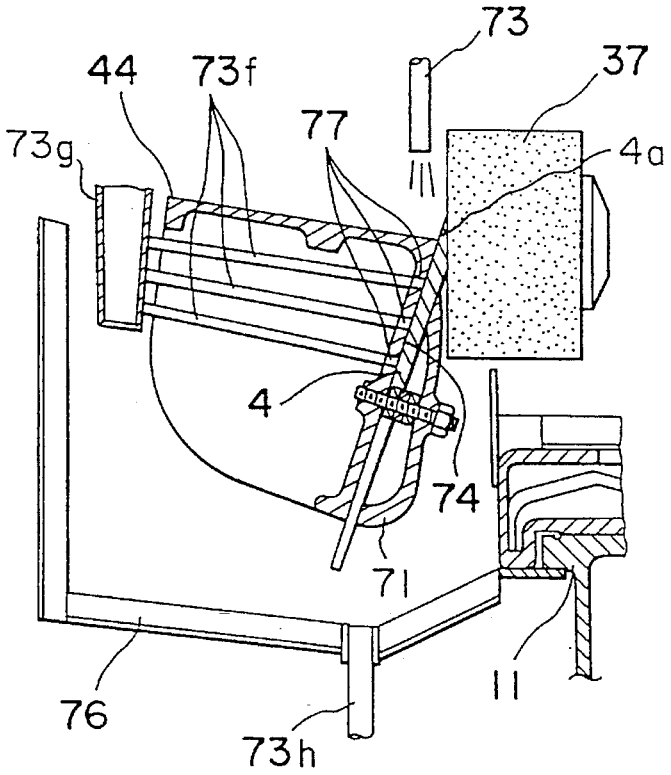
FIG. 19 is a view showing an additional modification of the cooling device.

Referring to FIG. 19, there is shown a blade mount 44 including in its front surface 74 a plurality of cooling medium passage holes 77. A plurality of flexible pipe **73*f* are correspondingly connected to the cooling medium passage holes 77. In the same manner as the above, a cooling medium receiver 76 is disposed along the entire length of the blade mount 44. The cooling medium discharged from the receiver 76 is circulated through a flexible tube 73*h* and a cooling device and returned into a header 73*g***.

Figure 20:
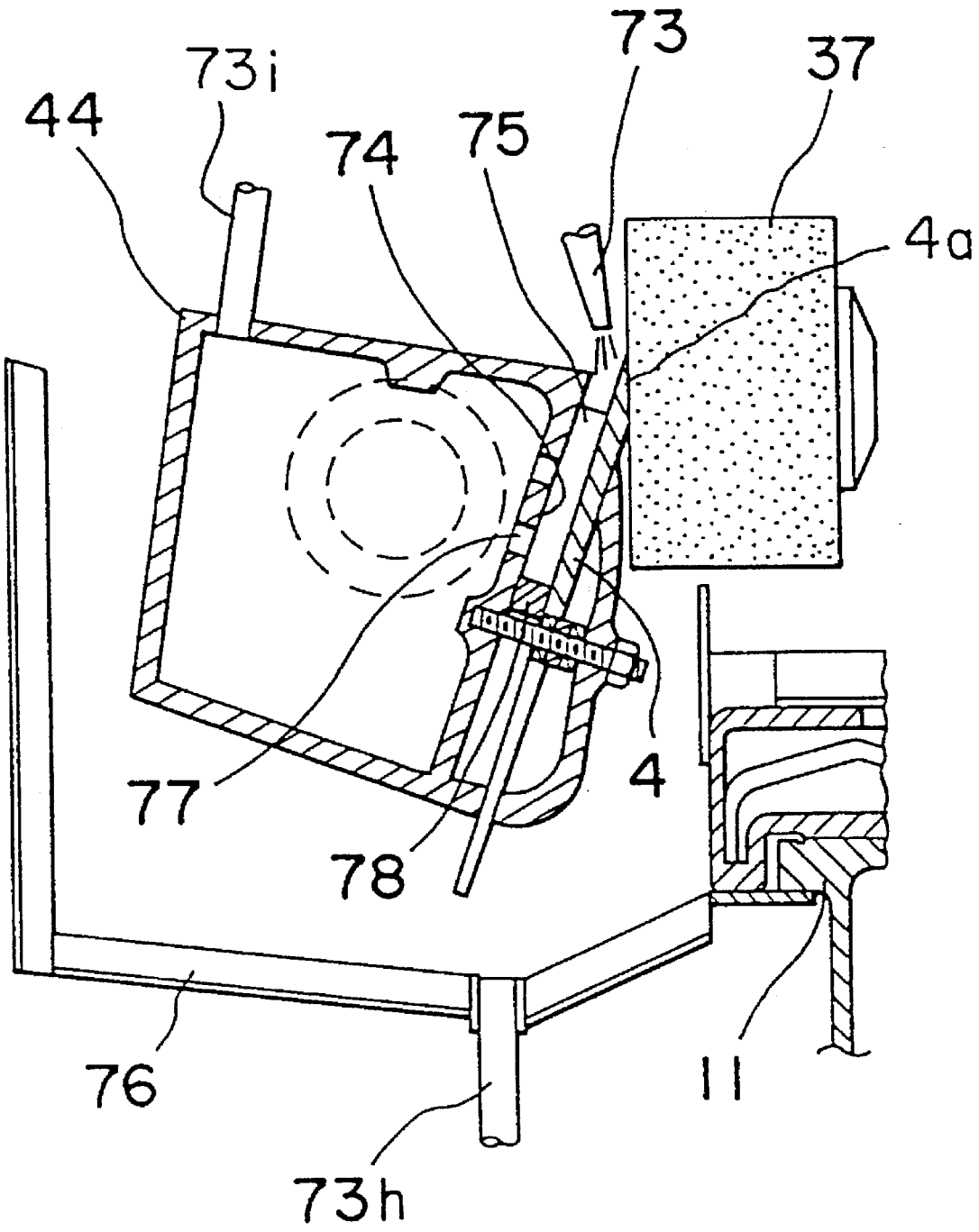
FIG. 20 is a view of a still additional modification of the cooling device.

Referring to FIG. 20, there is shown a box-shaped blade mount 44 hermetically formed and including a hollow space into or from which a cooling medium is at all times charged or discharged under pressure by way of a flexible tube **73*i* and a flexible tube 73*h*, to thereby maintain substantially uniform the temperature throughout the blade mount 44 in the longitudinal and vertical directions. The blade mounting head 44 further has a flat front surface 74 having a plurality of openings 77 which are arranged at intervals and serve as fluid paths. The blade mounting head 44 has on the front surface 74 a plurality of parallel ribs 75 projecting therefrom. A plurality of cross bars 78 are transversely mounted between the bottom ends of the ribs 75. Thus, the cooling medium within the head 44 is supplied through the openings 77 into the spaces between the ribs 75, and then flows downward into the back side of the blade 4 so as to be retained in the vicinity of the lowermost cross-bars, then overflowing from the cutting edge 4*a***, to thereby greatly reduce the supply of the cooling medium.

The cooling devices described with reference to FIGS. 14 through 20 are intended to prevent heat generation and resultant distortion of the blade 4 and the blade mount 44, by supplying a cooling medium to the blade and the blade mount. In contrast, the cooling device shown in FIGS. 21 and 22 is intended to maintain the entire device in a constantly cooled state by supplying the cooling medium to the blade 4 and the blade mount 44 and by supplying the cooling medium to also the entire grinding device.

Figure 21:
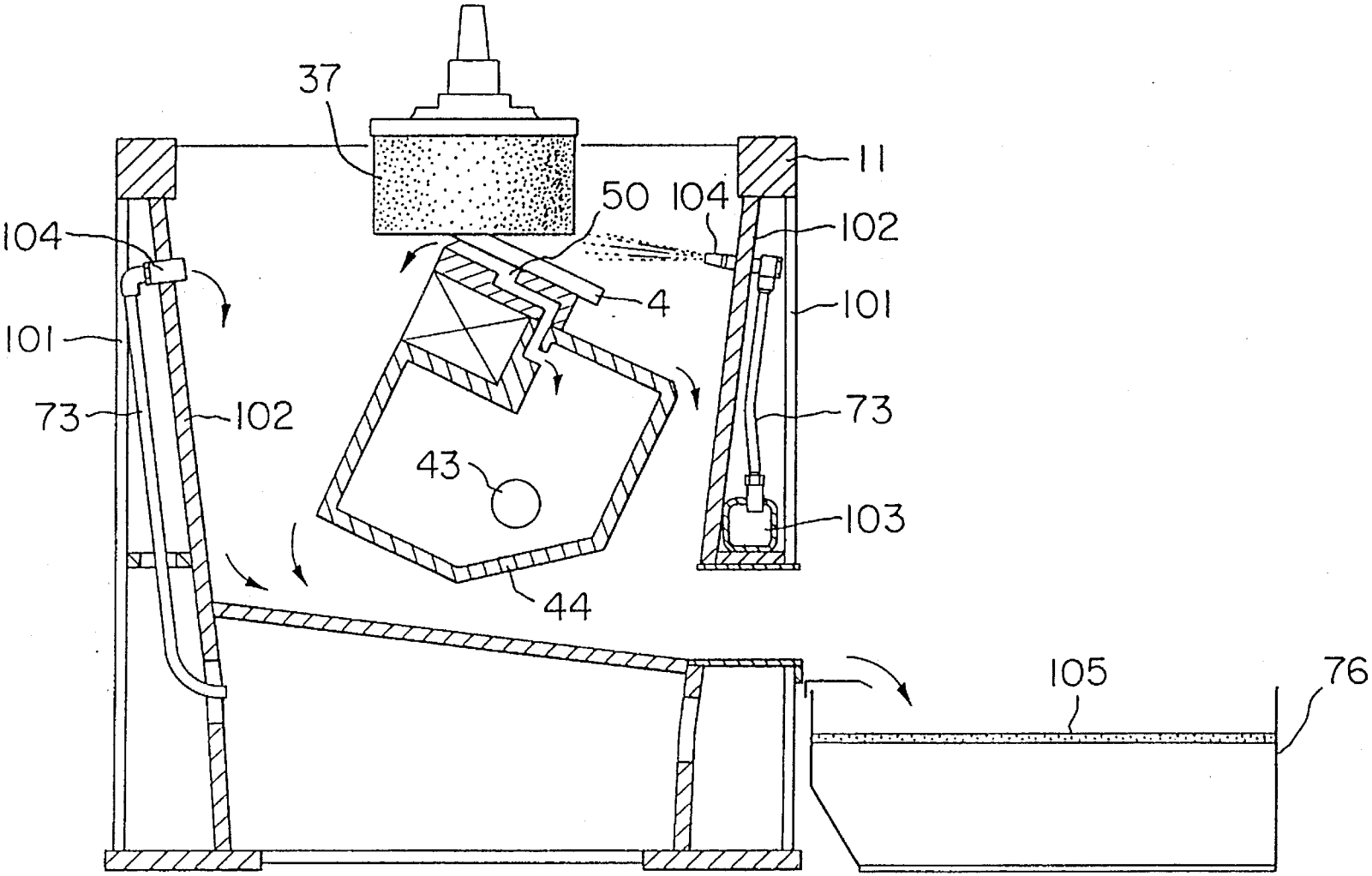
FIG. 21 is a view, in vertical section, of another cooling device.
Figure 22:
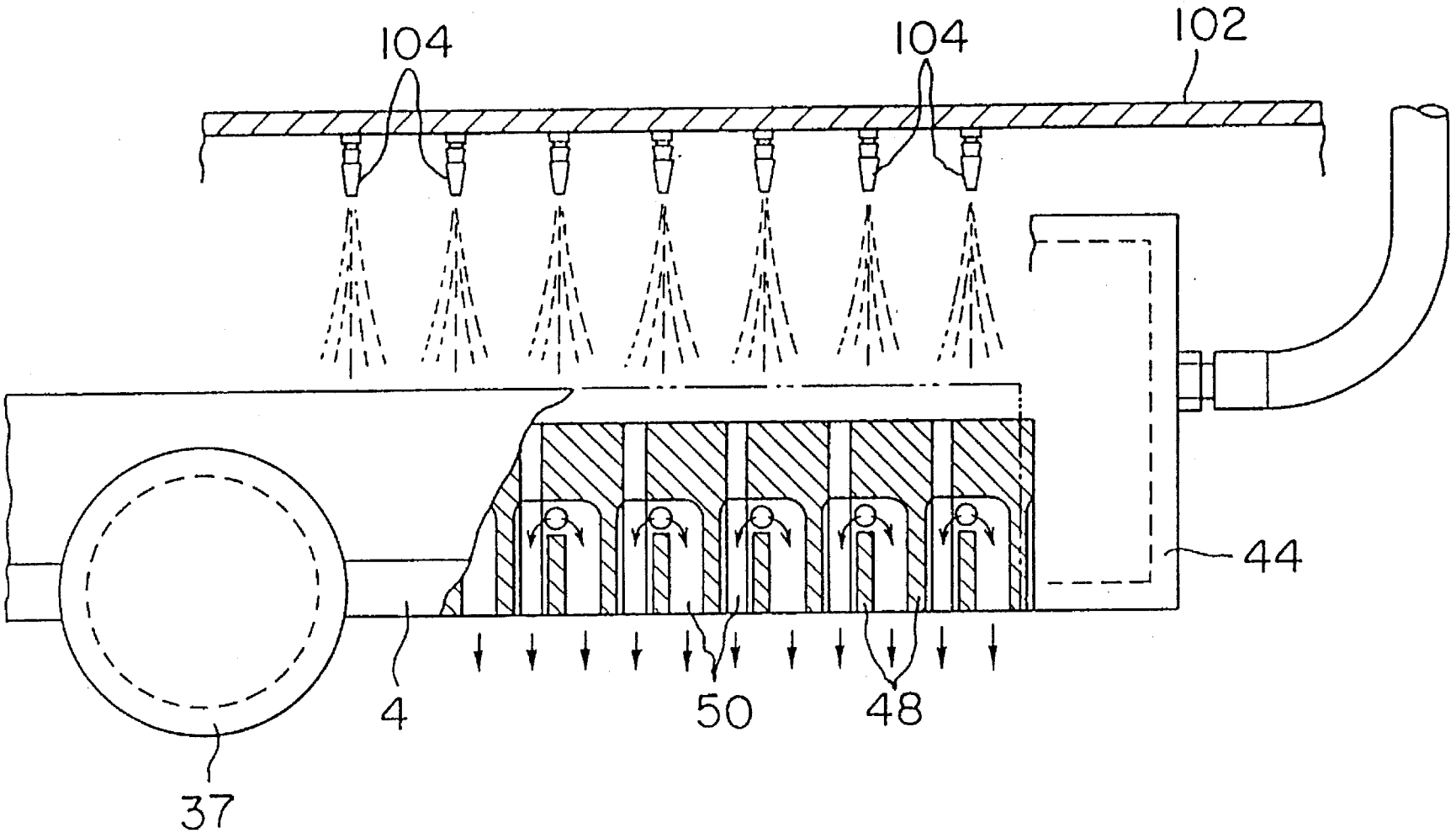
FIG. 22 is a horizontal section of a part of the cooling device shown in FIG. 21.

As shown in FIG. 21, the bed 11 has opposite outer and inner side walls 101 and 102 between which a cooling medium supply pipe 103 is provided to supply the cooling medium longitudinally of the bed 11. Flexible tubes 73 extend from the supply pipe 103 and terminate at ejector nozzles 104, respectively. These nozzles 104 eject the cooling medium against the blade mount 44 and the blade 4 thereon to cool them. Part of the ejected cooling medium flows down the inner surface of the inner walls 102 as shown. As a result, the atmosphere within the space between the opposite inner side walls 102 is entirely cooled so that the cooled atmosphere cools the once used and warmed cooling medium. The cooling medium that has performed the dual function of cooling flows down into a reservoir 76 for recovery while passing through a non-woven fabric 105 functioning as a filter for removing foreign particles such as abrasive particles and so on. It will thus be understood that the interior space of the bed 11 is cooled entirely and maintained at a constant reduced temperature so that distortion of the bed 11 with respect to the longitudinal direction thereof is prevented with resultant effective grinding operation. As shown in FIG. 22, the blade mount 44 has substantially the same internal structure as shown in FIG. 7.

According to a main feature of the invention as described above, heat generation during the grinding operation is effectively prevented so that undesirable distortion of the knife blade that has been ground does not occur after the grinding operation.

According to a further feature of the invention, when grinding a variety of elongated knives in blade shape used for a veneer lathe or a veneer slicer, the grinding start height or level can be determined by automatically contact-detecting the level of the cutting edge of the blade fixedly mounted on the blade mount, thus enabling prevention of collision of the grinding wheel with the cutting edge and shortening of the idle grinding time, which have been problems in the prior ark.

Furthermore, selection of a grinding wheel suitable for the condition of the cutting edge face can be made easily whereby the grinding time is shortened.

Further, knife blades which have suffered from cutouts and recesses in the region of the cutting edge due to a catch of particles of metal and sand while cutting raw lumber, are first subjected to a grinding by a coarse grade grinding wheel for abrasively eliminating the cutouts and recesses and then to a grinding by a finer grade grinding wheel for the removal of coarse surface roughness and so on which has not been removed by the conventional finish of the edge. Such two-stage or multi-stage grinding can be carried out efficiently according to the present invention.

Furthermore, the invention provides an effective way of grinding the back side of the cutting edge for removing local laterally deformed portions on the cutting edge.

What is claimed is:

1. A method for grinding an elongated knife blade having a cutting edge along a longitudinal side thereof, comprising the steps of:

fixing the elongated knife blade to a mounting surface of a blade mount;

reciprocating a grinding wheel supported by a carriage along and in contact with the cutting edge to grind the same; and maintaining a major portion of a major surface of the knife blade on the mounting surface in constant contact with a cooling medium supplied while the grinding wheel is grinding the cutting edge.

2. The method according to claim 1, wherein said major surface of the knife blade is a back surface of the knife blade, facing the mounting surface of the blade mount.

3. The method according to claim 1, wherein said major surface of the knife blade is a front surface of the knife blade, opposite the mounting surface of the blade mount.

4. The method according to claim 1, wherein the cooling medium is supplied through the blade mount to the mounting surface thereof.

5. The method according to claim 1, wherein the major surface of the knife blade is dipped in the cooling medium.

6. The method according to claim 1, wherein the blade mount and the knife blade are dipped in the cooling medium.

7. The method according to claim 1, further comprising the step of supplying the cooling medium to the knife blade from above through a nozzle which is reciprocated with the grinding wheel.

8. The method according to claim 1, wherein the major surface of the knife blade is mounted on the mounting surface with a space interposed therebetween, and the cooling medium is supplied into the space.

9. The method according to claim 1, wherein the cooling medium is supplied onto the knife blade and the blade mount, and an atmosphere covering the blade mount and knife blade is entirely cooled by the cooling medium.

10. The method according to claim 1, further comprising the steps of:

measuring a height distance of said carriage for the grinding wheel from an upper surface of the cutting edge of the knife blade;

comparing the measured distance with an actual height of the grinding wheel above said upper surface to calculate an amount of displacement of the grinding wheel toward said upper surface; and moving the grinding wheel toward the upper surface of the cutting edge and to a grinding start level.

11. The method according to claim 10, wherein the height distance is measured at a plurality of positions on the length of the knife blade, and a minimum distance from the measured distances is compared with the actual height of the grinding wheel.

12. The method according to claim is further comprising the steps of:

lowering the grinding wheel toward an upper surface of the cutting edge to a grinding start level;

moving the grinding wheel to cause it to abut against said upper surface;

detecting the abutment; and raising the grinding wheel to a slightly higher level responsive to the detection of the abutment.

13. The method according to claim 12, further comprising the steps of:

raising the grinding wheel further above said higher level.

14. The method according to claim 12, wherein the detection of the abutment is effected by detecting a change of resistance torque imparted to the grinding wheel.

15. The method according to claim 1, wherein the grinding wheel is driven by a secondary shaft which is driven by a motive drive shaft.

16. The method according to claim 1, wherein said grinding wheel is operated to grind a front surface of the cutting edge, and another grinding wheel is operated to grind a back surface of the cutting edge.

17. An apparatus for grinding an elongated knife blade having a cutting edge along a longitudinal side thereof, comprising:

a blade mount having a mounting surface for fixedly mounting the elongated knife blade thereon;

a grinding wheel;

a carriage movable reciprocatingly along the knife blade on the blade mount and carrying the grinding wheel;

motive means for moving the carriage so as to cause the grinding wheel carried by the carriage to reciprocatingly move along and in contact with the cutting edge of the knife blade to grind the same; and cooling means provided for the mounting surface of the blade mount for maintaining a major portion of a major surface of the knife blade mounted on said mounting surface in constant contact with a cooling medium supplied to the cooling means, while the grinding wheel is grinding the cutting edge.

18. The apparatus according to claim 17, wherein said cooling means comprises a reservoir provided on the mounting surface of the blade mount for receiving and storing therein the cooling medium, said reservoir providing a space for accommodating the knife blade, and means for supplying the cooling medium into the reservoir.

19. The apparatus according to claim 17, wherein said cooling means comprises ribs formed on the mounting surface of the blade mount and providing spaces therebetween, said ribs having top surfaces for supporting the knife blade thereon, and means for supplying the cooling medium into said spaces.

20. The apparatus according to claim 17, wherein said cooling means comprises a cooling medium receiver enclosing the blade mount for storing the cooling medium to dip the blade mount therein, and means for supplying the cooling medium into said receiver.

21. The apparatus according to claim 17, wherein said cooling means comprises means for supplying the cooling medium to the mounting surface from within the blade mount.

22. The apparatus according to claim 21, wherein said mounting surface has openings therein for allowing the cooling medium within the blade mount to contact the surface of the blade mounted on the mounting surface.

23. The apparatus according to claim 22, wherein each of said openings has valve means for opening responsive to mounting of the knife blade on the mounting surface.

24. The apparatus according to claim 17, wherein said cooling means comprises wall means enclosing the blade mount, and nozzle means for ejecting the cooling medium against the blade mount, the blade thereon and the wall means to produce a cooled atmosphere within a space defined by the wall means.

25. The apparatus according to claim 17, further comprising:

distance measuring means provided on the carriage for measuring a vertical height distance of the carriage from an upper surface of the cutting edge of the blade;

means responsive to the measured height distance to compare it with an actual height of the grinding wheel above said upper surface for calculating an amount of downward displacement of the grinding wheel; and means responsive to the calculated amount to move the grinding wheel toward the upper surface of the cutting edge to a grinding start level slightly above the upper surface.

26. The apparatus according to claim 17, further comprising:

means for detecting abutment of the grinding wheel against an upper surface of the knife blade mounted on the blade mount during downward feed of the grinding wheel; and means responsive to operation of the abutment detecting means to raise the grinding wheel to a slightly higher level.

27. The apparatus according to claim 26, further comprising:

means for further raising the grinding wheel to a level slightly above said higher level.

28. The apparatus according to claim 26, wherein said means for detecting abutment comprises means for detecting an increase of resistance torque imparted to the grinding wheel.

29. The apparatus according to claim 17, further comprising:

a rotational shaft detachably supporting the grinding wheel;

motor means having an output shaft; and means interconnecting said output shaft with said rotational shaft.

30. The apparatus according to claim 29, further comprising:

a grinding wheel magazine for storing grinding wheels; and means provided in the magazine for changing the grinding wheel between the magazine and said rotational shaft.

31. The apparatus according to claim 17, wherein said grinding wheel is for grinding a front surface of the cutting edge of the blade, and said apparatus further comprises a second grinding wheel mounted on said carriage, said second grinding wheel being movable horizontally relative to, and toward and away from the carriage and having a back grinding surface for grinding a back surface of the cutting edge.

32. The apparatus according to claim 31, wherein said back grinding surface is an annular surface sloping to become lower from its center to its outer periphery.

* * * * *